US012151137B2

(12) United States Patent
Rayman et al.

(10) Patent No.: US 12,151,137 B2
(45) Date of Patent: Nov. 26, 2024

(54) EXERCISE APPARATUS

(71) Applicant: SCULPTED PARTNERS LLC, New York, NY (US)

(72) Inventors: Erika Rayman, New York, NY (US); Henner Jahns, Los Angeles, CA (US); Holger Zerfass, Atlanta, GA (US)

( * ) Notice: Subject to any disclaimer, the term of this patent is extended or adjusted under 35 U.S.C. 154(b) by 185 days.

(21) Appl. No.: 17/826,440

(22) Filed: May 27, 2022

(65) Prior Publication Data

US 2023/0201657 A1 Jun. 29, 2023

Related U.S. Application Data

(60) Provisional application No. 63/337,850, filed on May 3, 2022, provisional application No. 63/293,603, filed on Dec. 23, 2021.

(51) Int. Cl.
*A63B 23/04* (2006.01)
*A63B 21/00* (2006.01)

(52) U.S. Cl.
CPC ..... *A63B 23/0405* (2013.01); *A63B 21/4031* (2015.10); *A63B 21/4034* (2015.10); *A63B 21/4035* (2015.10); *A63B 21/4047* (2015.10); *A63B 2023/0411* (2013.01)

(58) Field of Classification Search
CPC ..... A63B 21/0405; A63B 21/4031; A63B 21/4034; A63B 21/4035; A63B 21/4047; A63B 23/0405
See application file for complete search history.

(56) References Cited

U.S. PATENT DOCUMENTS 3,446,503 A * 5/1969 Lawton ..... A63B 21/4047 482/96
4,500,089 A 2/1985 Jones
4,600,189 A 7/1986 Olschansky et al.
4,618,140 A 10/1986 Brown
4,621,807 A 11/1986 Stramer
4,627,616 A 12/1986 Kauffman
(Continued)

FOREIGN PATENT DOCUMENTS

CN 206026973 U 3/2017
JP H07-559 A 1/1995
(Continued)

OTHER PUBLICATIONS

DB Method, DB Method Assembly [online], Published: Sep. 21, 2020 Retrieved from the Internet <URL: https://www.youtube.com/watch?v=TKP0V5pQ2hU&t=3s > (Year: 2020).*
(Continued)

*Primary Examiner* — Zachary T Moore
(74) *Attorney, Agent, or Firm* — Norvell IP LLC

(57) ABSTRACT

An exercise apparatus for the exercise of a user's gluteal muscles though a supported seated squat downward from an upper starting position and an upward return movement. The apparatus includes at least one foot ramp having at least one foot support surface to support substantially all of the user's feet in a position that is elevated off the ground during the exercise. The positioning of the user with the foot ramps in combination with the rest of the exercise apparatus provides numerous benefits to the squat exercise.

22 Claims, 20 Drawing Sheets

(56) References Cited

U.S. PATENT DOCUMENTS

| | | | | |
|---|---|---|---|---|
| 4,743,010 | A * | 5/1988 | Geraci | A63B 22/0076 482/95 |
| 2,201,036 | A | 5/1990 | Guerrier | |
| 5,178,599 | A | 1/1993 | Scott | |
| 5,188,577 | A | 2/1993 | Young et al. | |
| 5,201,694 | A | 4/1993 | Zappel | |
| 5,328,426 | A | 7/1994 | Vendette | |
| 5,356,358 | A * | 10/1994 | Chen | A63B 21/4035 482/57 |
| 5,554,086 | A * | 9/1996 | Habing | A63B 21/0628 482/142 |
| 5,643,147 | A | 7/1997 | Huang | |
| 5,827,158 | A | 10/1998 | Drecksel | |
| 5,951,448 | A | 9/1999 | Bolland | |
| 7,247,128 | B2 | 7/2007 | Oga | |
| 7,452,311 | B2 | 11/2008 | Barnes et al. | |
| 7,662,076 | B1 | 2/2010 | Ho | |
| 9,375,607 | B1 * | 6/2016 | Rayman | A63B 21/068 |
| 9,662,536 | B1 * | 5/2017 | Lin | A63B 21/4033 |
| 10,258,819 | B2 | 4/2019 | Duffy | |
| 10,792,352 | B2 | 10/2020 | Moki et al. | |
| 10,799,754 | B2 | 10/2020 | Duffy | |
| 11,117,017 | B2 | 9/2021 | Rayman | |
| 2002/0016236 | A1 * | 2/2002 | Stearns | A63B 21/157 482/57 |
| 2003/0092541 | A1 | 5/2003 | Giannelli | |
| 2004/0043877 | A1 | 3/2004 | Brown | |
| 2005/0187073 | A1 * | 8/2005 | Krull | A63B 69/06 482/52 |
| 2005/0227826 | A1 | 10/2005 | Oga | |
| 2008/0020911 | A1 | 1/2008 | Castello Neto | |
| 2008/0039298 | A1 | 2/2008 | Steinmetz | |
| 2009/0036276 | A1 | 2/2009 | Loach | |
| 2011/0275497 | A1 | 11/2011 | Lorusso | |
| 2012/0058866 | A1 | 3/2012 | Hongo et al. | |
| 2013/0324374 | A1 | 12/2013 | Ellis | |
| 2016/0051427 | A1 | 2/2016 | Purwar et al. | |
| 2016/0082315 | A1 | 3/2016 | Carter et al. | |
| 2016/0263424 | A1 | 9/2016 | LaCaze | |
| 2017/0087406 | A1 | 3/2017 | Duffy | |
| 2017/0203149 | A1 | 7/2017 | D'Amico | |
| 2017/0319905 | A1 | 11/2017 | O'Connor | |
| 2020/0289872 | A1 | 9/2020 | Teeter Leier et al. | |
| 2021/0307497 | A1 | 10/2021 | Patterson et al. | |

FOREIGN PATENT DOCUMENTS

| | | | |
|---|---|---|---|
| JP | 3830486 | B2 | 10/2006 |
| JP | 2011-188995 | A | 9/2011 |
| JP | 3202923 | U | 3/2016 |
| WO | 2014/172700 | A | 10/2014 |

OTHER PUBLICATIONS

International Search Report and Written Opinion of the International Searching Authority for International Patent Application No. PCT/US2022/053111.

The DB Method Perfect Squat Machine. Amazon Nov. 4, 2020 Retrieved from internet URL: https://www.amazon.com/DB-METHOD-Squat-Perfected/dp/B07JW8NZCY.

Information about AB Squat machine from www.absquat.com.

Non-Final Office Action for U.S. Appl. No. 18/421,154, dated Mar. 26, 2024, 13 Pages.

* cited by examiner

EXERCISE APPARATUS

BACKGROUND

Field of the Invention

The present invention relates to a new and improved exercise apparatus. In particular, the present invention relates to an exercise apparatus that is manually operated and targets the gluteal muscle group by providing optimal positioning and support of the user's buttocks and feet during the exercise.

Related Art

The three main muscles of the human gluteal group, the gluteus maximus, medius, and minimus (the "glutes") make up the buttocks and one of the largest muscle groups in the human body. The glutes are the physical foundation that allows humans to stand upright and maintain the trunk in an erect posture. The glutes allow the body to regain an erect position after stooping and also collectively act as a rotator of the legs. Further, the glutes power human's bipedal locomotion, from walking to running, jumping or moving laterally. In addition, a well-formed buttocks is typically viewed as an integral part of an attractive appearance.

Despite the importance of the glutes, many people have underdeveloped glutes. Modern lifestyles often involve large amounts of sitting, which effectively shuts down the glutes. Thus, numerous exercises, including squats and lunges, have been developed to target the gluteal muscles. These exercises, which traditionally rely upon the carrying of a barbell on the shoulders of the individual, require some level of dexterity and balance, as well as strength to lift the barbell into position. It may be uncomfortable for the user to support and maintain the weights in the proper position. For effective exercise, proper form is required. Exercise devices, such as a power cage or an upright frame known as a Smith machine, can be used to perform squats, and allow the weights to travel vertically along a predetermined path, preventing the barbell from moving forwards, backwards or sideways.

Proper from is particularly important for squat exercises. To optimally load the glutes in a squat exercise, a forward motion of the trunk must be counterbalanced with backward motion of the hips, and, at the same time, the spine must be stabilized. This requires bodily awareness, coordination, stability, and balance. However, unless an individual has been specifically trained for the proper motion, the squat will often be performed wrongly, for example, in a quad-dominant fashion that can stress the knees and back without actually improving the glutes.

U.S. Pat. No. 9,375,607 ("the '607 Patent"), which is to the assignee of the subject application and which is incorporated by reference in its entirety, describes an exercise apparatus that can be used to properly exercise the glutes and methods for properly exercising the glutes. The apparatus described in the '607 Patent includes uprights having handles, a buttocks support assembly, and foot ramps that are configured to support part of the user's feet during the exercise. In the exercises described therein, a user is positioned such that the user's buttocks is in contact with the pad and the user holds onto the handles, with the buttocks support assembly being in an initial, generally horizontal position, such that the gluteal muscles are in the state of initial tension to maintain the contact with the pad. During the exercise, the user is made to move with the buttocks assembly pivoting downwardly to a lower position in a slow controlled motion by controlled action of the gluteal group, and then the buttocks assembly is returned to the starting position by a controlled gluteal group action, with the user's arms remaining in a fully extended position throughout a full range of exercise motion. The apparatus and method described in the '607 Patent provide an effective exercise for the gluteal muscles.

U.S. Pat. No. 11,117,017 ("the '017 Patent"), which is to the assignee of the subject application and which is incorporated by reference in its entirety, describes another type of apparatus that can be used to exercise the glutes and methods for exercising the glutes. The apparatus described in the '017 Patent includes uprights having handles, a buttocks support assembly, and a foot ramp that is configured to support part of the user's feet during the exercise. The apparatus also includes a weight stack that is operatively connected buttocks support assembly. During exercise, the weight stack provides a resistive force motion of the buttocks assembly downwardly and an assistive force in motion of the buttocks support assembly upward. The apparatus described in the '017 Patent is generally suitable for commercial-type use, such as in a gym.

SUMMARY OF THE INVENTION

Embodiments of the invention descried herein provide for improvements to the exercise described in the '607 and '017 Patents. The exercises described herein even further targets the gluteal muscles through positioning and support of the user's buttocks and feet on the exercise apparatus.

According to one aspect of the invention, an exercise apparatus comprises a base including at least one beam extending in a direction X and at least one upright beam connected to the base and extending upward of the base in a direction Y that is perpendicular to the direction X, with the upright beam including at least one handle area configured to be held by a user and the upright beam being positioned at a front side of the apparatus. A buttocks support assembly is positioned rearward of the upright beam, the buttocks support assembly being pivotal with respect to the at least one upright beam between a first position and a second position, with the first position being farther from the base in the direction Y than the second position is from the base in the direct Y. A foot ramp structure is positioned rearward of the upright beam, with the foot ramp structure including at least one foot support surface having a surface area sufficient to support substantially all of the user's feet in a position that is elevated off the ground.

According to another aspect of the invention, an exercise apparatus comprises a base including at least one beam extending in a direction X and at least one upright beam connected to the base and extending upward of the base in a direction Y that is perpendicular to the direction X, the upright beam including at least one handle area configured to be held by a user, with the upright beam being positioned at a front side of the apparatus. A buttocks support assembly is positioned rearward of the upright beam, the buttocks support assembly being pivotal with respect to the at least one upright beam between a first position and a second position, with the first position being farther from the base in the direction Y than the second position is from the base in the direction Y, and the buttocks support assembly including a surface configured to support the buttocks of the user. The apparatus also includes a foot ramp structure positioned rearward of the upright beam, the foot ramp structure including at least one foot support surface configured to support the user's feet. The apparatus is configured such that when the buttocks support assembly is in the first position, a distance in the direction X from a center of the surface of the buttocks support surface to a center of the foot support surface is about 30 cm to about 60 cm, and a distance in the direction Y from the center of the surface of the buttocks support surface to a center of the foot support surface is about 80 cm to about 90 cm.

According to another aspect, an exercise apparatus includes a base including at least one beam extending in a direction X. At least one upright beam is connected to the base and extends upward of the base in a direction Y that is perpendicular to the direction X, with the upright beam including at least one handle area configured to be held by a user, and with the upright beam being positioned at a front side of the apparatus. A buttocks support assembly is positioned rearward of the upright beam, the buttocks support assembly being pivotal with respect to the at least one upright handle between a first position and a second position, with the first position being farther from the base in the direction Y than the second position is from the base in the direction Y. A linking rod connects the base and the buttocks support assembly. A foot ramp structure is positioned rearward of the upright beam, with the foot ramp structure including at least one foot support surface having a surface area of at least about 500 $cm^2$ to support the user's feet in a position that is elevated off the ground. The at least one foot support surface is formed at an angle of about 10° to about 35° relative to the ground.

According to yet another embodiment of the invention, an exercise apparatus is provided for a squat exercise. The apparatus includes a base including at least one beam, And at least one upright beam connected to the base and extending upward of the base, with the upright beam including at least one handle area configured to be held by a user, and the upright beam being positioned at a front side of the apparatus. A buttocks support assembly is positioned rearward of the upright beam, with the buttocks support assembly being pivotal with respect to the at least one upright handle between a first position and a second position, and with the first position being higher than the second position. The apparatus also includes a weight support beam operatively connected to the buttocks support assembly, the weight support beam being configured to support one or more weights. A foot ramp structure is positioned between the upright beam and the buttocks support assembly, with the foot ramp structure including at least one foot support surface having a surface area sufficient to support substantially all of the user's feet in a position that is elevated off the ground

BRIEF DESCRIPTION OF THE DRAWINGS

A fuller understanding of embodiments of the present invention will be achieved upon consideration of the following detailed description of an illustrative embodiment of the invention, when reviewed in conjunction with the annexed figures wherein.

DETAILED DESCRIPTION OF THE INVENTION

Embodiments of the present invention are directed to an exercise apparatus of the general type in which the user is supported by the apparatus to perform a squatting maneuver, with the device allowing control over both the squatting maneuver and return of the user to the upright position.

Figure 1:
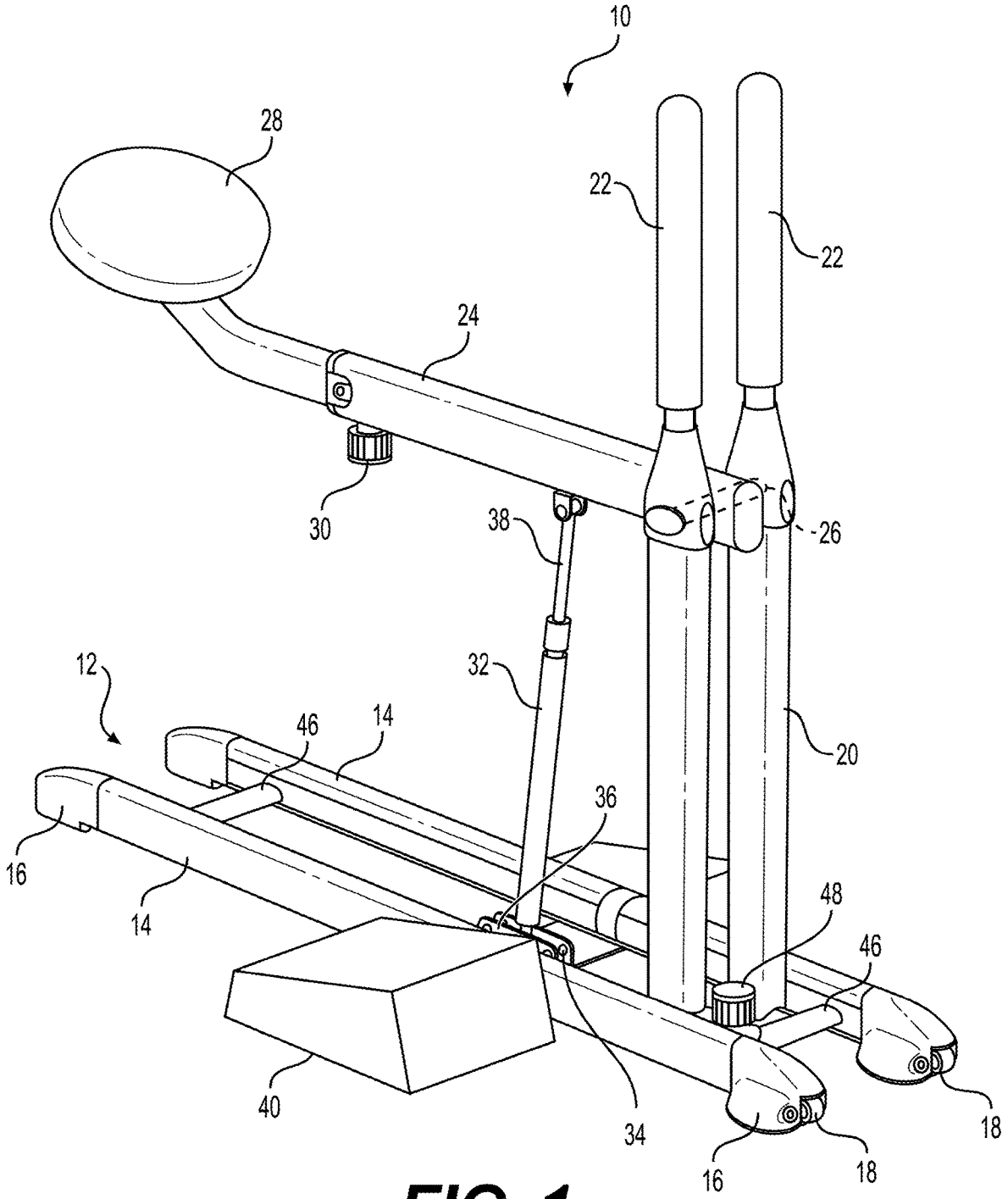
FIG. 1 is a perspective view of the apparatus in the upright, starting position for an exercise.
Figure 2:
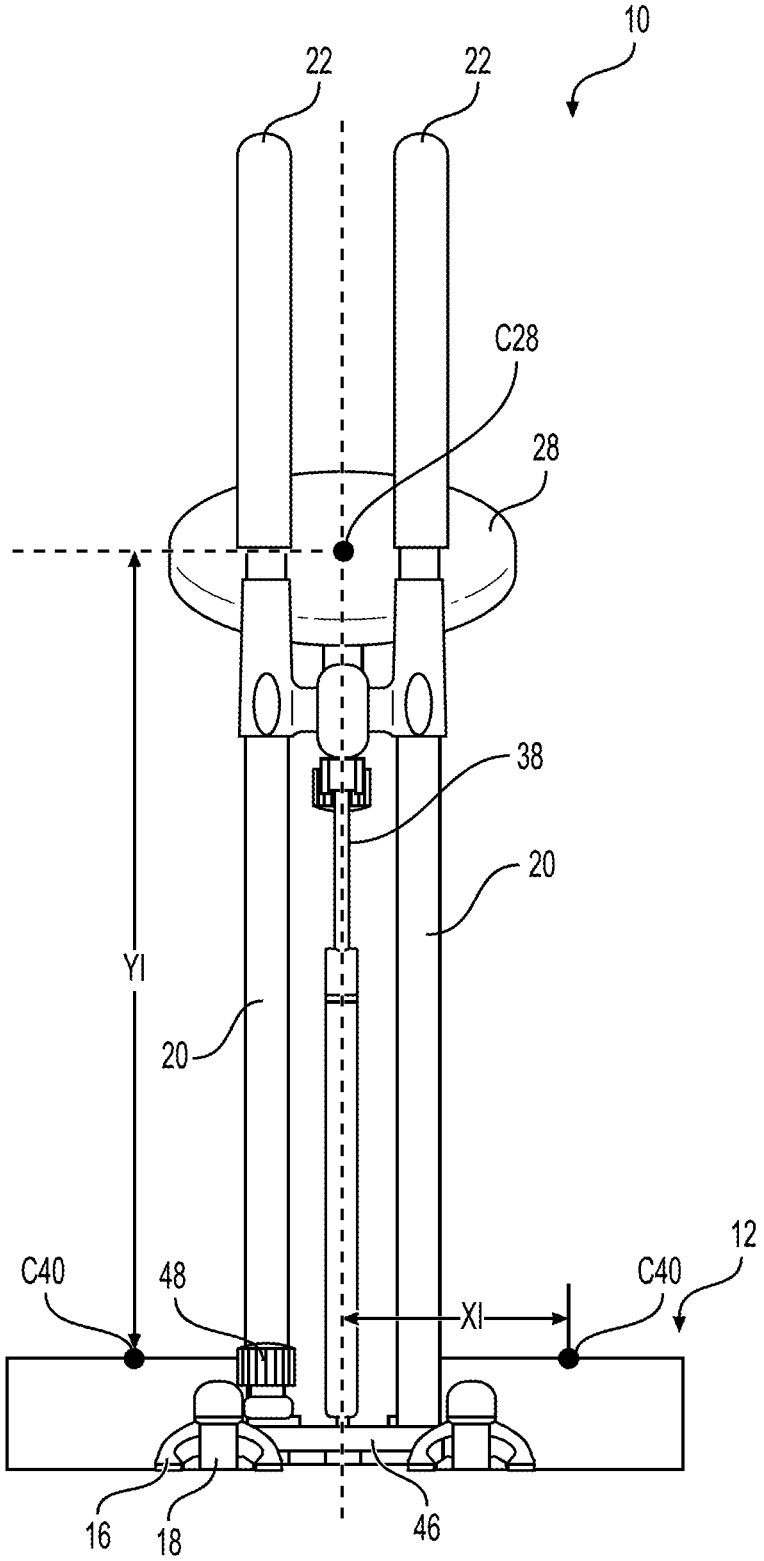
FIG. 2 is a front elevation view of the apparatus.
Figure 3:
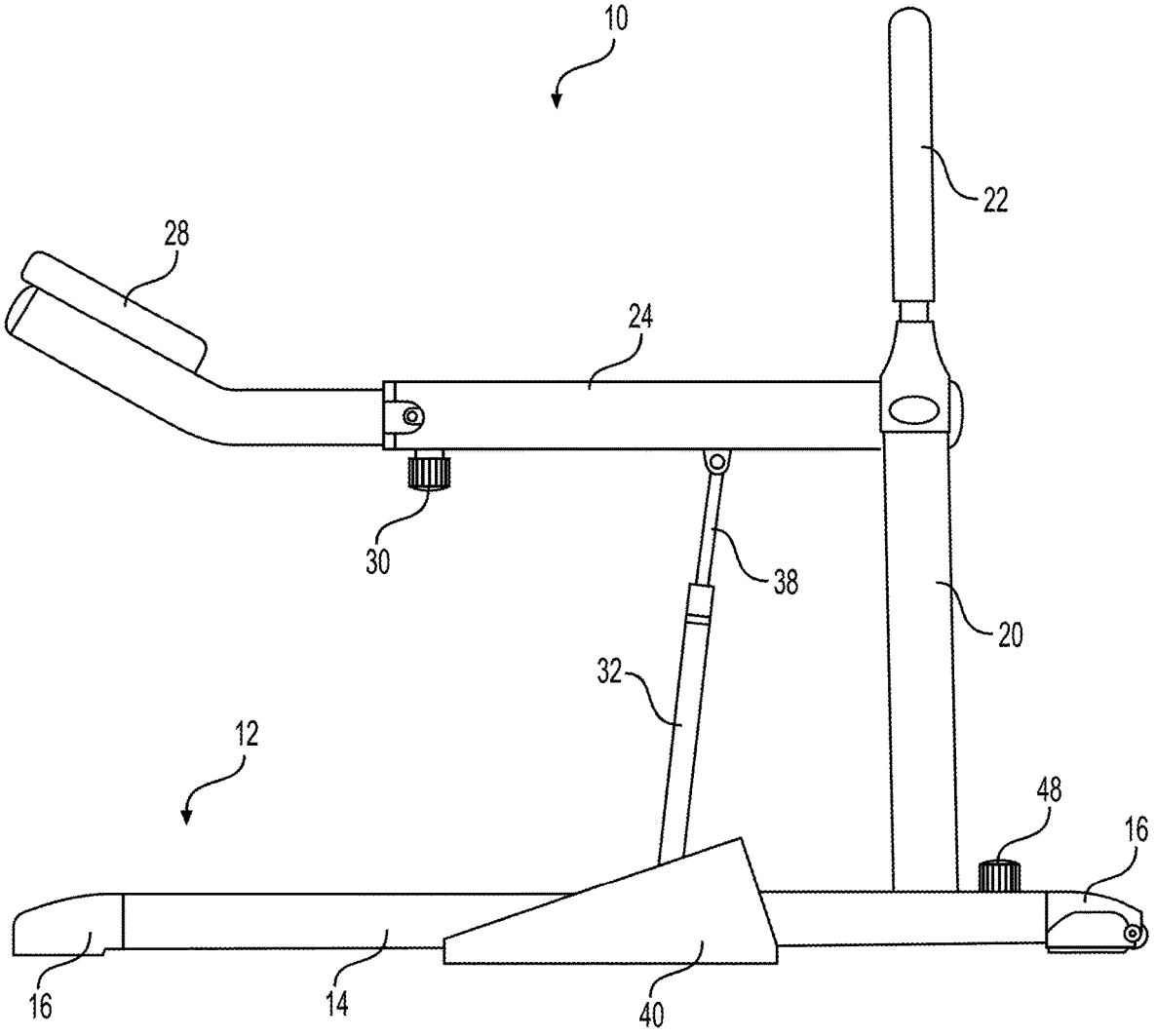
FIG. 3 is a side elevation view of the apparatus.

As seen in drawings, and particularly FIGS. 1-3, an example embodiment of the exercise apparatus 10 comprises a base 12 formed of a pair of parallel horizontal beams 14. Floor pads 16 may be located at their ends, raising the beams 14 slightly above the floor surface along their lengths and providing a set of non-slip contact surfaces with the floor. Wheels 18 may be journaled in a pair of the pads in a known manner to assist moving the apparatus. The wheels 18 could be placed at the front of the beams 14 as depicted, at the rear of the beams 14, or both the front and rear of the beams 14. The two beams 14 are joined at their ends by transverse beams 46.

A pair of upright beams 20 extend upwardly from the base beams 14 and terminate at their upper ends in a pair of handles 22. The handles 22 may be provided with a cushioned covering, as known in the art, to provide a comfortable surface for the user's hands. The handles 22 may also be adjustable in height to accommodate users of varying heights. The upright beams 20 may be pivotally connected to the base beams 14 to allow them to be folded downwardly to a storage position, as will be discussed below. Those skilled in the art will recognize that other configurations of the base beams 14, upright beams 20 and handles 22 are possible, such as a single base beam, single upright beam and single handle structure.

The upright beams 20 provide a mounting for the forward end of buttocks pad support arm 24, which likewise may be pivotally connected to the upright beams 20 by a transverse rod 26. The arm 24 supports at its distal end buttock pad surface 28 which, when the arm is in an upper, generally horizontal, position, defines an acute angle with respect to the horizontal. The angle may be on the order of 45 degrees. The support arm 24 may be of a telescoping construction, the overall length of which may be maintained by locking knob assembly 30 which, in accordance with known methods, can apply retaining pressure against the inner telescoping element and/or pass a pin through a chosen one of a plurality of spaced holes in the inner element aligned with the knob assembly.

A linkage system 32 including at least one rod connects the base 12 and the pad support arm 24. In depicted embodiment of the invention, the linkage system 32 includes a biasing element, such as damper. The biasing element provides an opposing force against downward motion of the buttocks pad 28 and support arm 24, as well as a returning force to drive the pad and support arm upward from a lowered position. The damper may be adjustable to control the force level. As depicted, the damper may be a shock absorber-like unit, providing a resistance to compression of the damper piston into the damper body and providing a restoring force directed to extension of the piston to the extended position. In some embodiments, a dial structure may be included to allow a user to change the resistance to compression provided by the damper. Also, the adjustment may be performed, for example, by varying the connection position of the damper along the base through selective mounting in a chosen one of the spaced holes 34 in u-shaped retainer 36. As the angle of the damper with respect to the vertical increases, the degree of compression effected by the travel of piston rod 38 lessens over the range of support arm motion, with a corresponding lessening in the amount of force needed for the compression.

The base beams 14 also support a pair of foot ramps 40 that project outwardly and upwardly from the beams 14, with the foot ramps 40 positioned rearward the upright beams 20. The foot ramps 40 will be described in detail below. It should be noted that while the depicted exercise apparatus 10 includes two foot ramps 40 on opposite sides of the apparatus 10, in other embodiments a single foot ramp structure could be provide, with the single structure providing surface areas on the two sides of the apparatus 10 for the users feet to be placed. An example of singular foot ramp structure will also be described below.

Figure 4:
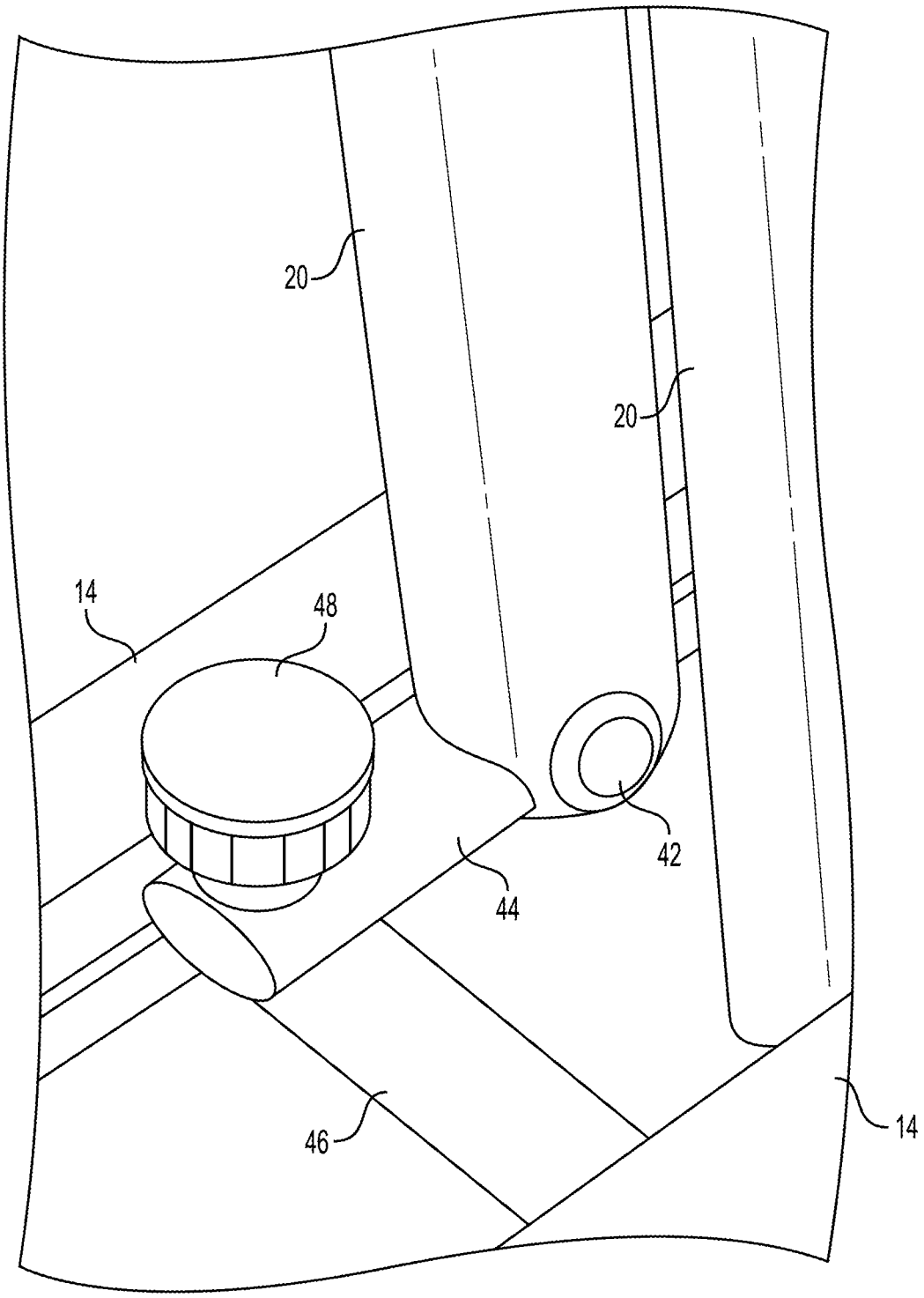
FIG. 4 is a detail view of a locking bracket for the apparatus.
Figure 5:
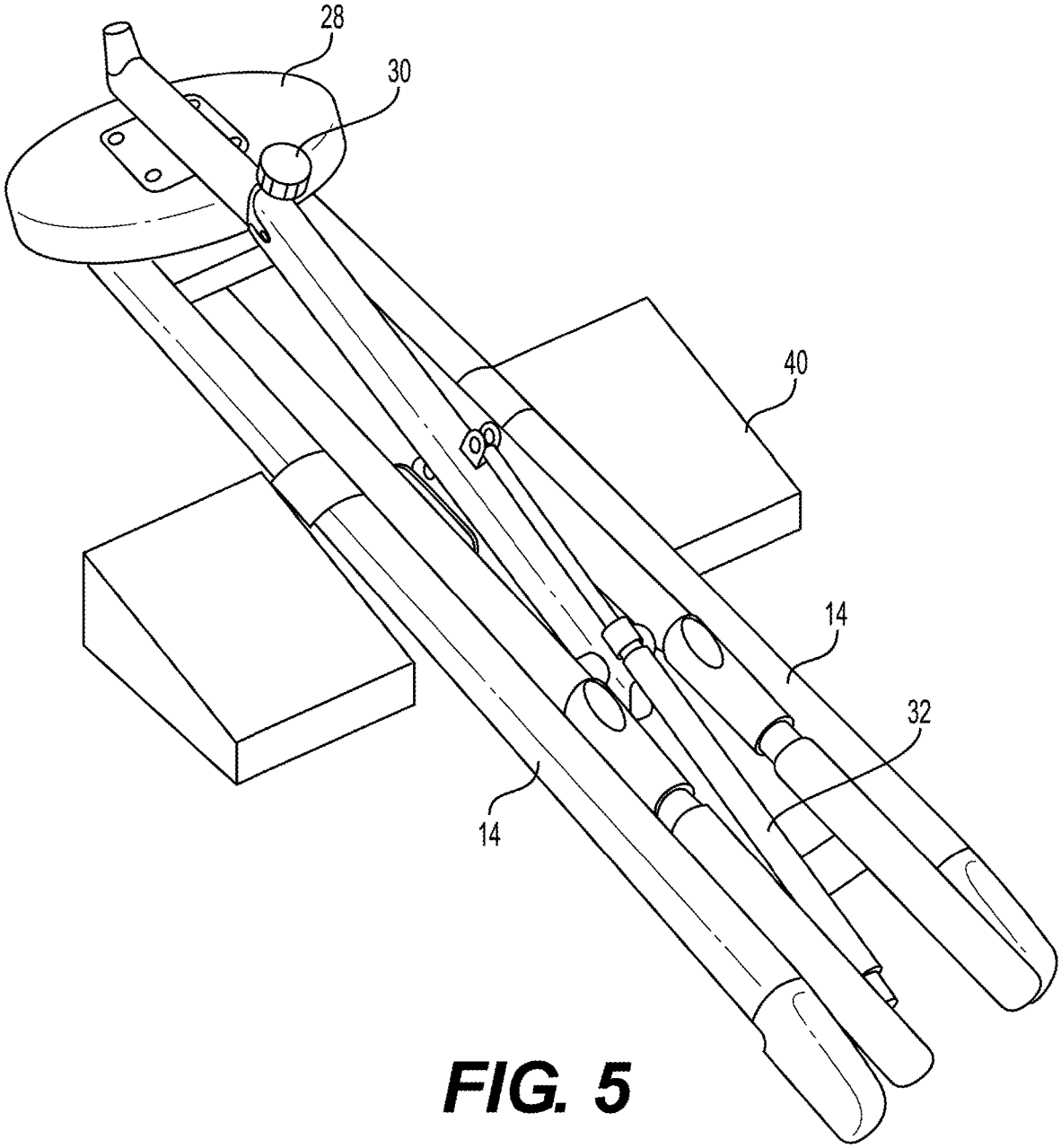
FIG. 5 is a perspective view of the apparatus in a folded, storage configuration.

As detailed in FIG. 4, the upright beams 20 are journaled for pivoting between the upright position as depicted in FIGS. 1-3 and a collapsed position as illustrated in FIG. 5 by a pair of axle joints 42 connecting them to the base beams 14. Arm 44 extends forwardly from one of the upright beams 20 proximate its axle joints, and supports a locking member 48 comprising a threaded rod extending through the arm headed with an operating knob. It should be noted that while one arm 44 and one locking member 48 are depicted, in other embodiments two arms 48 and two locking members 48 may be provided such that an arm and locking member are associated with each of the upright beams 20. The locking member 48 is positioned to engage with a complementary threaded bore in the forward base transverse beam 46, such that when engaged the upright beams 20 are maintained in the vertical operating position. In other embodiments, instead of a locking member 48 a clamp is provided to maintain the upright beams 20 in the vertical operating position. When the rod and bore are manually disengaged the upright beams 20 may be pivoted back to lie between the base beams 14, as illustrated in FIG. 5. With the damper 32 disengaged from the retainer 36 the buttocks pad support arm 24 may be pivoted forward to in turn lie between the collapsed upright beams 20, the damper 32 in turn lying along the arm 24. So collapsed, the apparatus forms a compact unit for transport or storage. One end of the collapsed unit can be lifted, with the wheels at the opposite end allowing the unit to be rolled along as desired. To reassemble the apparatus the buttocks support arm 24 is pivoted back and the upright beams 20 raised to the operating position, being secured there by screwing down the locking member 48 into the transverse beam 46.

As discussed above, the '607 Patent describes an apparatus and method that provide for an effective exercise of the gluteal muscles. The apparatuses and methods described herein provide for even more effective exercises through different positioning of the user during a squatting exercise. This positioning is enabled, in part, through the configuration and placement of the foot ramps relative to the rest of the apparatus as described herein, with the foot ramps supporting the user's feet at positions that are elevated off of the ground.

The foot support surface area of the foot ramps and elevated foot positioning afforded by the foot ramps provide several benefits. For example, the foot ramps present a surface area for different foot positioning and foot angles (e.g, with toes pointed inward or outward). Having a broader surface area enables more comprehensive foot positioning options and enables users of different body proportions more options to find a foot position that suites herself or himself. Changes in foot positioning allows squats to be performed with the apparatus that target specific aspects of hip and glute development via relatively wider or narrow stances. For example, wider stances can involve more hip adduction/inner thigh strengthening. Changes in foot angle also allow for more variability in hip joint rotation, which thereby gives access to different neuromuscular motor patterns for more fully developed hip and gluteal strengthening. Moreover, by allowing for different foot positions, more advanced squatting exercises can be performed.

As yet another benefit, the elevated angle of the foot ramps relative to the buttocks support pad of the apparatus makes it easier for the user to keep their body weight in their heels and thereby correct a natural tendency for a user to pull her or his weight forward into their toes during a squatting exercise. In other words, the positioning of the user on an apparatus with foot ramps according to embodiments of the invention shifts the user's weight back into the heels and thereby helps load the glutes during a squatting exercise. In addition, the positioning of the user on an apparatus with foot ramps frees up neurological energy by helping the user to find the right heel pressure without having to dorsiflex their ankles (i.e. pull the top of feet upward). That is, the positioning and angle of the foot ramps naturally positions the user to push through their heels—the better heel pressure enables a snore direct connection to the posterior chain of muscles, and, thus, better glute activation.

Figure 6:
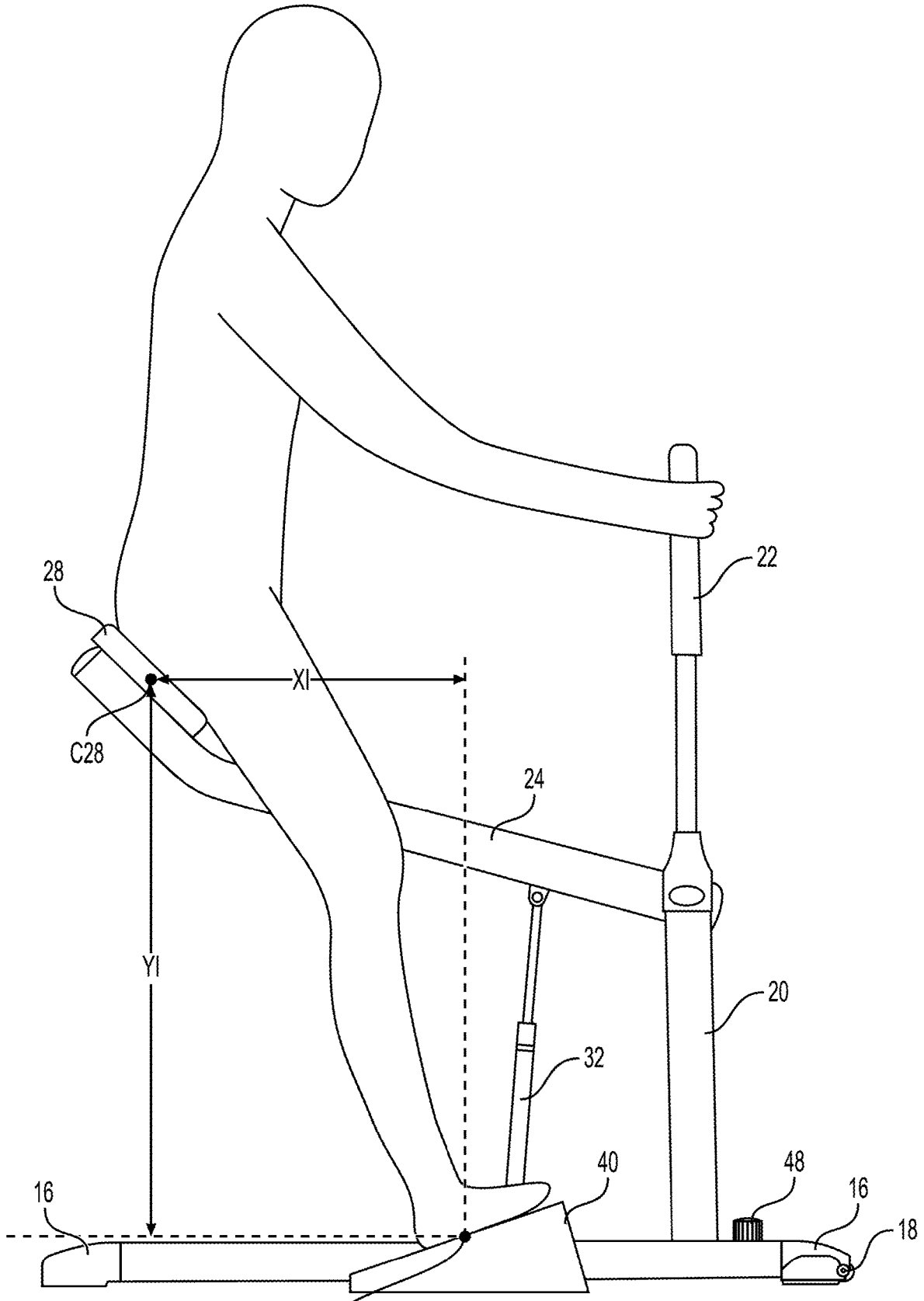
FIG. 6 is a side elevation view of the apparatus in the upright starting position, depicting the orientation of a user thereon.
Figure 7:
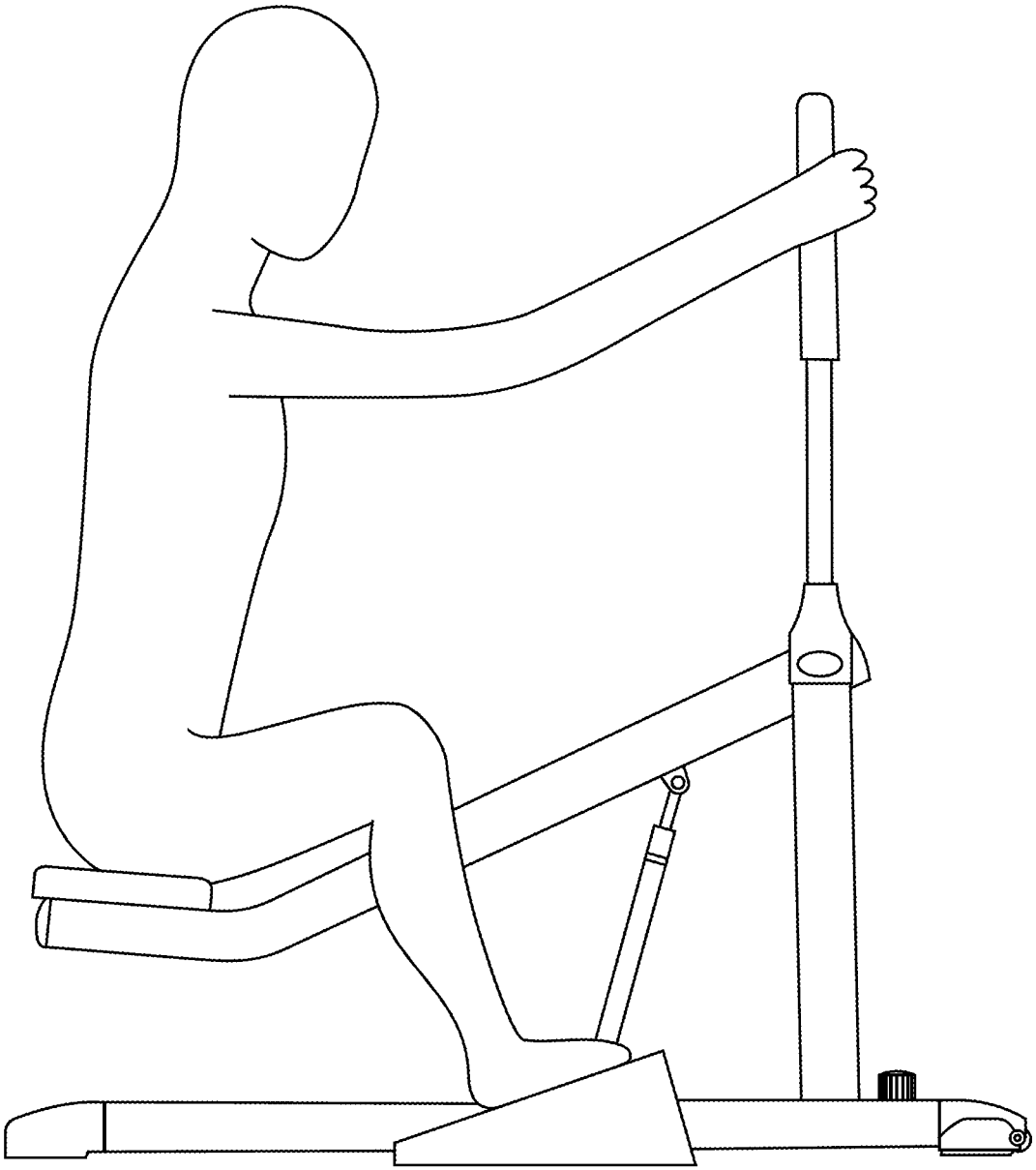
FIG. 7 is a side elevation view of the apparatus in a lowered position, depicting the orientation of a user in a squat position thereon.

FIGS. 6 and 7 depict the positioning of a user with an apparatus according to embodiments of the invention while performing methods according to embodiments of the invention. A user of the apparatus straddles the buttocks support arm 24, resting the buttocks on the pad surface 28. The slope of the pad requires the user to maintain her position on the pad by tensing the leg and buttocks muscles, rather than simply sitting in a relaxed position on the pad. The user's feet are placed on the foot ramps 40, which provide a surface area sufficient to support substantially all of the user's feet in a position that is elevated off the ground. The distance between the buttocks pad 28 and the handles 22 is adjusted through the locking arm assembly 30 such that the user's arms are substantially extended and such that the user can maintain an erect position on the pad 28. As the user squats down in a controlled, slow manner, damper element of the linkage system provides an upward opposing force assisting in controlling the descent speed, with the user exercising the glutes to affect the desired controlled descent. Note, at the lower position shown in FIG. 7, the user's knees are positioned rearward of their toes to a position that is generally aligned with, or behind, the ankles. This positioning reduces pressure on the knees in the squat exercise. From a lowered position the user rises up, the damper's upward force assisting the user and again allowing the rise up to be in a slow controlled manner, the glutes being further exercised.

The squatting motion that is induced by the apparatus as shown in FIGS. 6 and 7 positions the user to gain the most benefits from the exercise that are hard to achieve from traditional squat exercises. The motion of the pad support arm 24 and pad 28 guides the user in the proper path so that her or his hips (and therefore glutes) are loaded. Traditional squats are thought of as "just down," which ultimately brings a person into the front of their body as the knees shoot forward and the quadriceps take over. But the motion guided by the apparatus with feedback tension provided by the apparatus as described herein directs a user back and down so as to follow a gentle arc that drives her or his weight into the hips and away from their knees. Further, muscular engagement is initiated by tension from the apparatus as the user enters the back and down path of the squat. In traditional squats, because gravity is acting downward there is nothing to spur a person's muscles to fire properly if the person is not highly trained and experienced with the squatting exercise. The apparatus described herein encourages tension from the lats, abs, hip flexors, and hamstrings in order to pull the user's body down. And with those muscles engaged, the glutes are in a primed position to drive the user out of the bottom position.

Figure 8A:
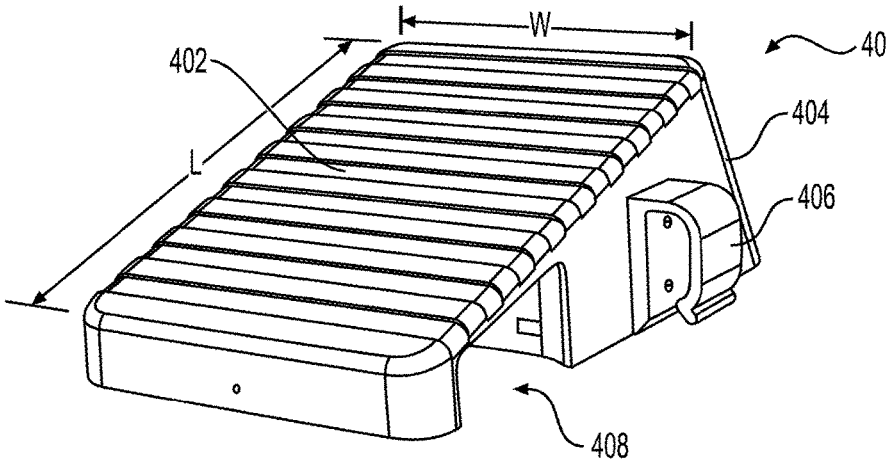
FIG. 8A, FIG. 8B, and FIG. 8C are views of a foot ramp according to an embodiment of the invention.
Figure 8B:
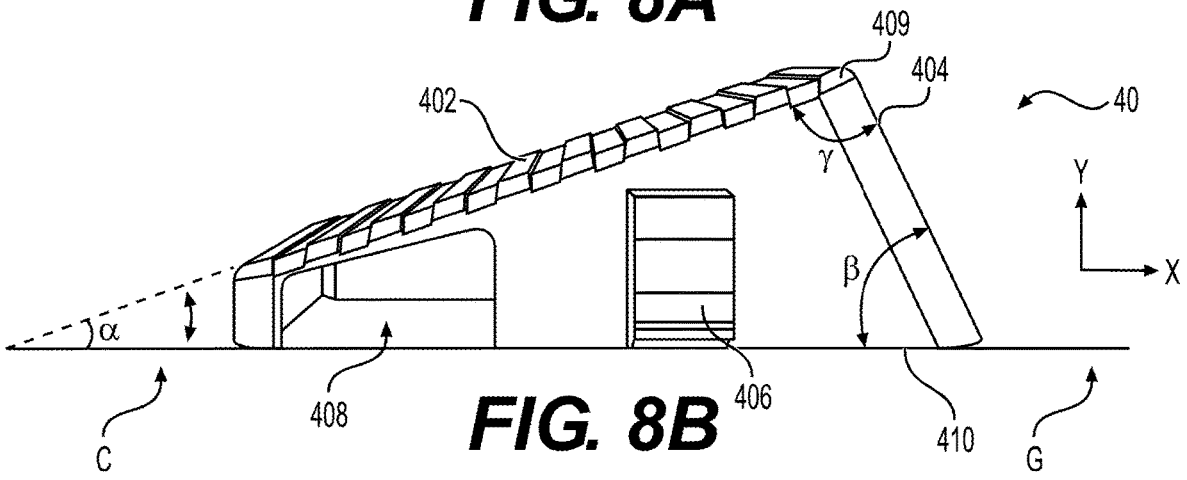
Figure 8C:
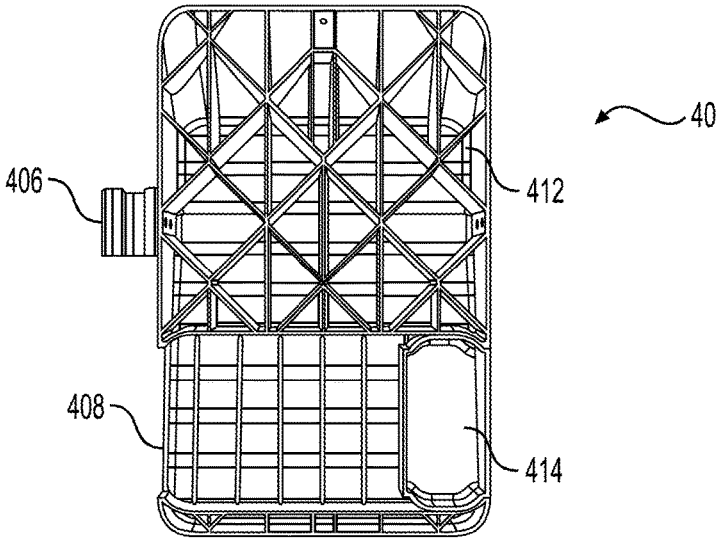
Figure 9:
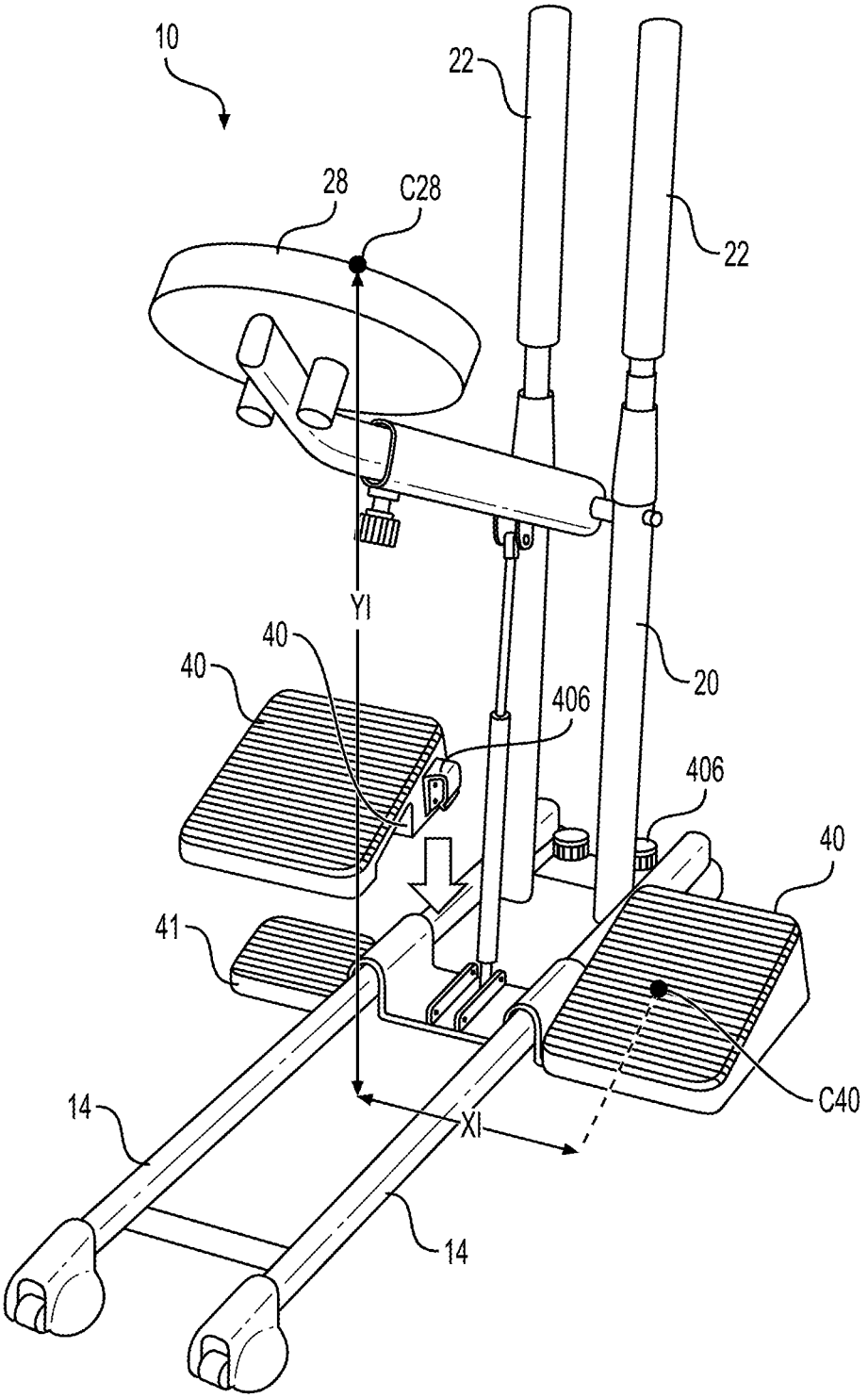
FIG. 9 is a view of an attachment of a root ramp of an apparatus according to an embodiment of the invention.

In order to align the user in a position that will achieve benefits such as those described above, in embodiments of the invention the exercise apparatus 10 is configured with particular ranges of distances in the horizontal X direction and vertical Y direction between the pad surface 28 and the foot ramps 40. In this regard, a distance X1 is a distance from a center C28 of the pad surface 28 to the center C40 of each of the foot support surfaces of the foot ramps 40 as measured in the horizontal direction, and a distance Y1 is a distance from a center C28 of the pad surface 28 to the center C40 of each of the foot support surfaces of the foot ramps 40 as measured in the vertical direction. Note, as the center of the pad surface 28 is not positioned directly over the centers C40 of each of the foot ramps in the vertical direction and the center of the pad surface 28 not directly aligned horizontally with each of the foot ramps, as can be seen in FIGS. 2, 8, and 9 the distances X1 and Y1 are the distances measured in the horizontal and vertical directions. Using other terminology, the distance X1 is the distance along a line that is perpendicular to a vertical plane that includes the center C28 of the pad surface 28 to a vertical plane that includes the center C40 of the foot support surface of the foot ramps 40, and the distance Y1 is the distance along a line that is perpendicular to a horizontal plane that includes the center C28 of the pad surface 28 to a horizontal plane that includes the center C40 of the foot support surface of the foot ramps 40. If the distances X1 and Y1 were construed as vectors, the distances X1 and Y1 vectors would add together to define vector on a straight line from the center C28 of the pad surface 28 to the centers C40 of the foot support surfaces of the foot ramps 40.

When the buttocks support assembly is in an uppermost position as shown in FIG. 6, the distance X1 in the horizontal direction from the center C28 of the pad surface 28 to the center C40 of each of the foot ramps 40 is in a range from about 30 cm to about 60 cm, and the distance Y1 in the vertical direction from the center C28 of the pad to the center C40 of each of the foot ramps 40 is in a range from about 80 cm to about 90 cm. As discussed above, the overall length of the arm 24 may be adjusted, and, as such, fall within the ranges for the distances X1 and Y1. These ranges accommodate the vast majority of sizes of adult humans. Moreover, the proportions of the apparatus are such that for a given adjustment to the arm 24 to accommodate a particular individual, the distances X1 and Y1 will be such to provide for a squatting exercise that achieves the numerous benefits described above.

FIG. 8(*a*) shows a top view of the foot ramp 40, FIG. 8(*b*) shows a side view of the foot ramp 40, and FIG. 8(*c*) shows a bottom view of the foot ramp 40. The foot ramp 40 includes a foot support surface 402 on which the user places his or her foot when using an apparatus as described herein. The surface 402 includes a plurality of raised ribs to provide better traction. As will be appreciated by those skilled in the art, a variety of other structures may be formed or placed on the surface 402 to provide for better traction. The foot ramp 40 also includes an opening 408 and a clip 406. As will be described below, the opening 408 and clip 406 allow for the foot ramp 40 to be attached to and detached from the rest of an apparatus structure according to embodiments of the invention.

As shown in FIG. 8(*a*), an angle $\alpha$ is formed between the surface (e.g., the ground) on which the foot ramp 40 is placed and the foot support surface 402 of the foot ramp 40. In more specific embodiments of the invention, the angle $\alpha$ may be between about 10° to about 35°.

In more specific embodiments of the invention, the angle $\alpha$ may be between about 13° to about 25°. In still more specific embodiments, the angle $\alpha$ is about 15° to about 20°. In a particular embodiment the angle is about 18°.

As shown in FIG. 8(*b*), the front surface 404 of the foot ramp 40 extends in the X direction from a top edge 409 of the foot ramp 40. Thus, the foot ramp 40 has the shape of a trapezoidal prism with an acute angle $\beta$ being formed between the front surface 404 and an edge 410 along the bottom of the foot ramp 40, with an obtuse angle $\gamma$ being formed between the foot support surface 402 and an edge of the front surface 404. In a specific embodiment of the invention, the angle $\beta$ is about 70°. Increased stability and strength are provided by forming the foot ramp 40 in the trapezoidal shape as compared to a foot ramp provided with a wedge shape. To further increase the strength and stability of the foot ramp 404, a webbing 412 is formed on the interior of the foot ramp 404, and a filler piece 414 is placed in part of the opening 408. In FIG. 8(*c*) the filler piece 414 is positioned on the right side of the foot ramp 40. However, the filler piece 414 could alternatively be positioned on the left side of the foot ramp 40. The alternating positioning of the filler piece 414 allows the foot ramp 404 to be easily adapted for placement on the right or left side of the exercise apparatus 10, as will be described below.

In embodiments of the invention, the foot support surface 402 is sized such that substantially all of an adult user's foot may set on the foot support surface 402. For example, the surface may be sized to have a length L of at least about 20 cm and a width of at least about 15 cm to thereby provide a surface area of at least about 300 $cm^2$to accommodate substantially all (if not all) of an adult user's foot. As another example, the surface may be sized to provide a surface area of at least about 500 $cm^2$ to accommodate most all adult users' feet. In a particular embodiment, the foot support surface 402 has a length of about 27 cm and a width of about 19 cm to thereby provide a surface area of about 513 $cm^2$. Those skilled in the art will appreciate how the length L and width W dimensions of the foot support surface 402 may be varied to accommodate a vast majority of adult user's feet.

FIG. 9 details how foot ramps 40 may be connected to the exercise apparatus 10. In this figure the foot ramp 40 on the right side of the apparatus 10 is secured in place, while the foot ramp 40 on the left side of the device is being moved into connection with the apparatus 10. To connect a foot ramp 40, the clip 406 is placed onto one of the horizontal beams 14 while the opening 408 fits over a smaller foot ramp 41 that extends perpendicular to the horizontal beams 14. In this manner, the foot ramps 40 are easily attachable to and detachable from the apparatus 10. Further, the apparatus 10 may be alternatively configured with the smaller foot ramp 41 or the larger foot ramp 40. By allowing for the use of different sized foot ramps, the exercise apparatus 10 can be tailored to a particular user's desire. For example, the larger foot ramps 40 may allow for different types of workouts and thereby improve workout optionality. Of course, those skill in the art will appreciate that having multiple sizes of foot ramps are not required to achieve the benefits of the invention described herein, the apparatus could be configured with only the larger foot ramps 40 being provided, e.g., with the larger foot ramps 40 screwed to the exercise apparatus 10.

Figure 10:
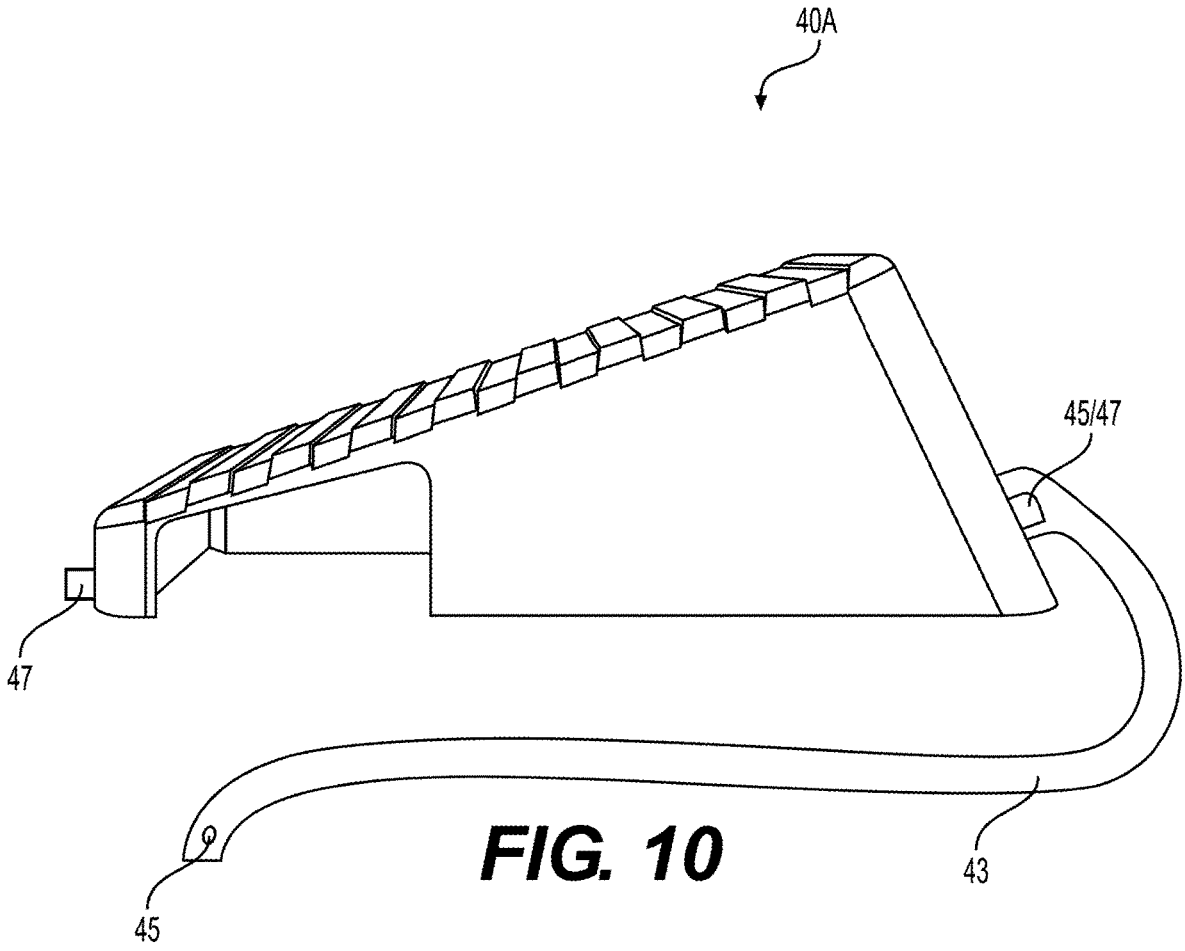
FIG. 10 is a view of a foot ramp according to an alternative embodiment of the invention.

FIG. 10 shows a foot ramp 40A according to an alternative embodiment of the invention. Unlike the foot ramp 40 described above, the foot ramp 40A does not include a clip 406 for securing the foot ramp 40A to the horizontal beam 14 of the exercise apparatus 10. Instead, a strap 43 is provided to secure the foot ramp 40A to the exercise apparatus. The strap 43 is detachably connected to the foot ramp 40A, for example, by corresponding button structures 45 and 47 provided on the strap 43 and the foot ramp 40A, respectively. When placed above a foot ramp 41 of the apparatus 10, the strap extends from one end of the foot ramp 40A, along the underside of the foot ramp 40A and the foot ramp 41, and then is secured at the other end of the foot ramp 40A.

Figure 11A:
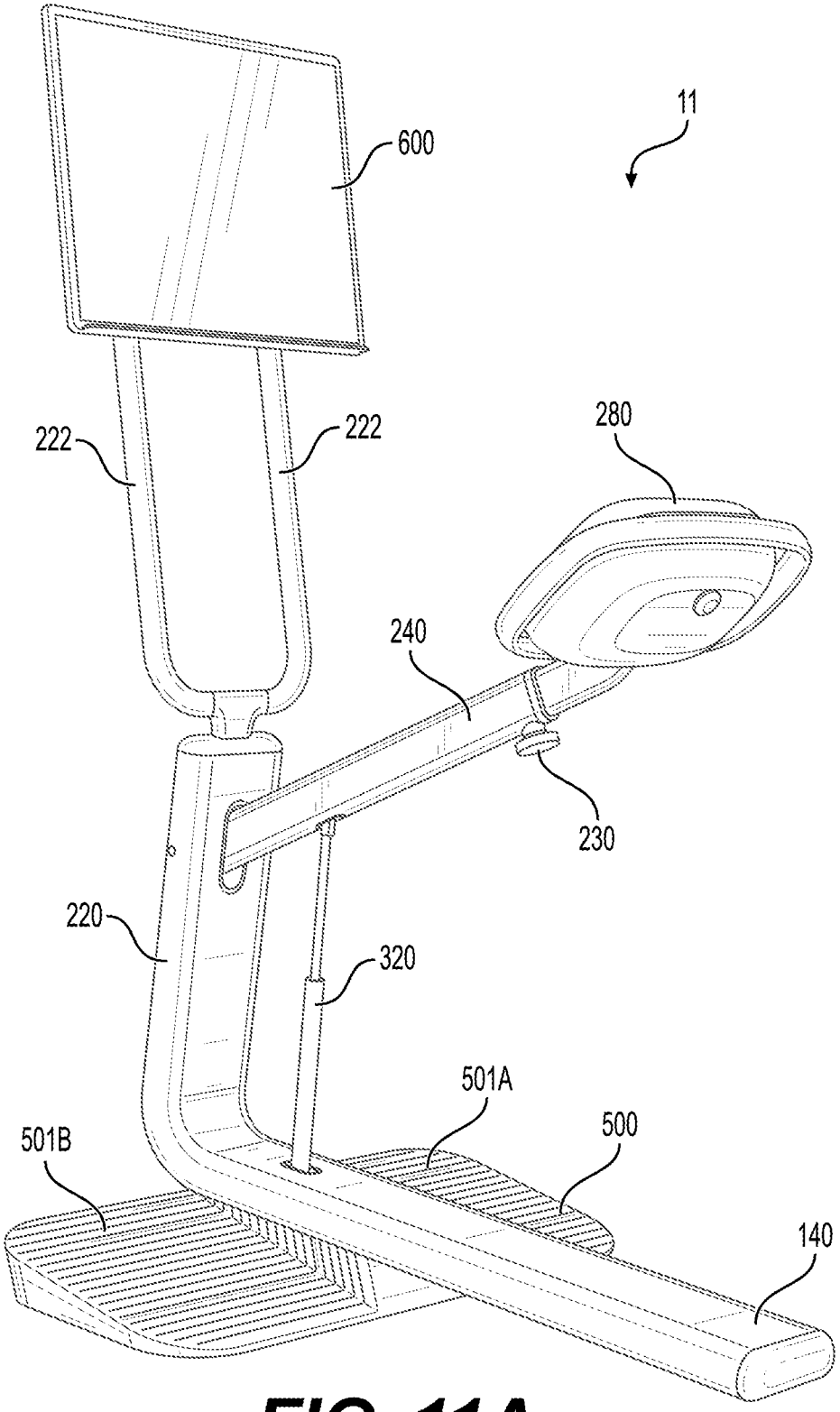
FIG. 11A is a perspective view of an apparatus.
Figure 11B:
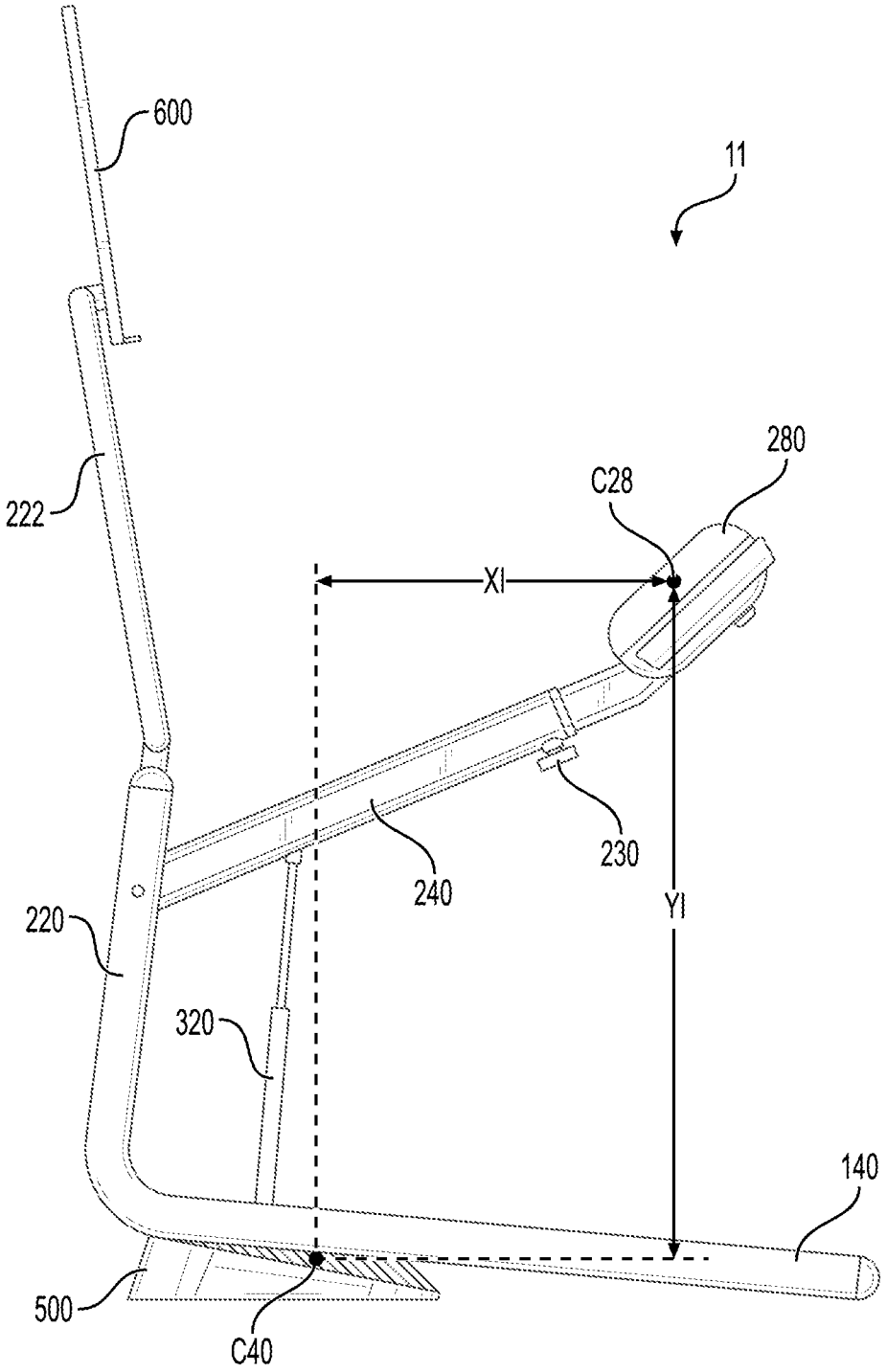
FIG. 11B is a side view of an apparatus.
Figure 11C:
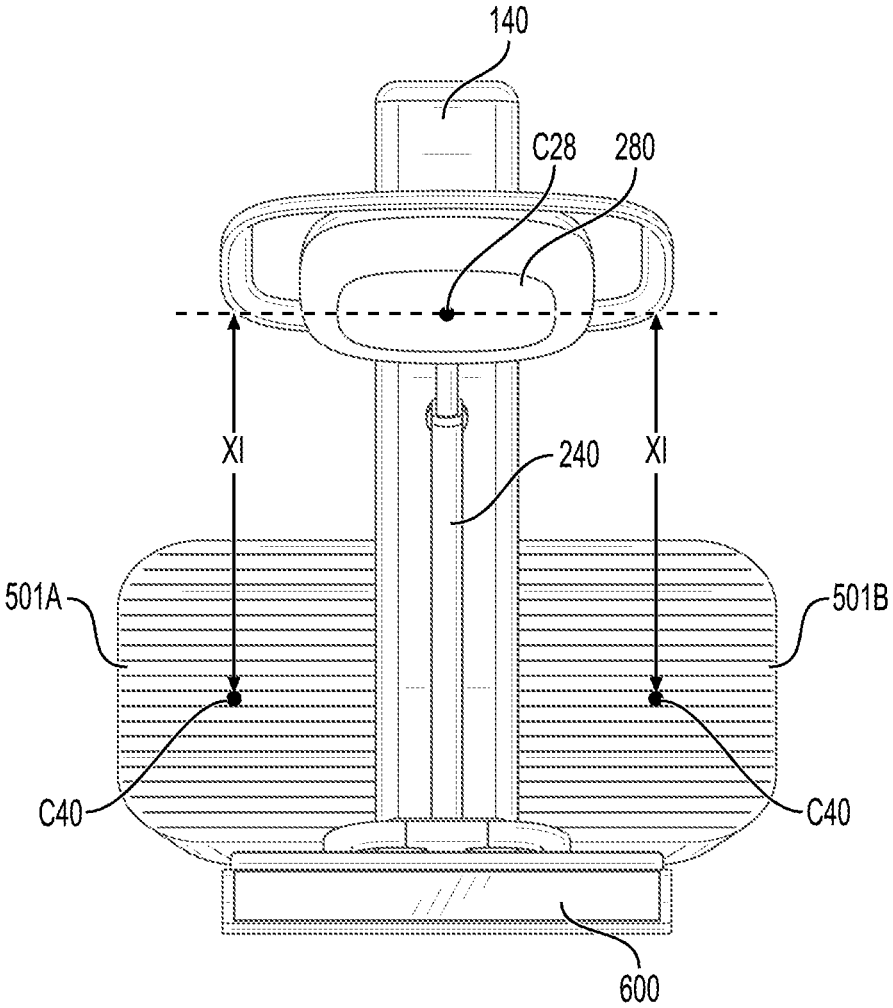
FIG. 11C is a top view of an apparatus, according to an alternative embodiment of the invention.

FIGS. 11A-11C show an exercise apparatus 11 according to an alternative embodiment of the invention. Similar to the above-described exercise apparatus 10, in this embodiment the apparatus 11 includes a horizontal beam 140, an upright beam 220, a linking rod 320, two handles 222, a pad support arm 240, and a buttock pad surface 280, with the support arm 240 having telescoping construction such that the overall length of the support arm 240 may be maintained by locking knob assembly 230. The exercise apparatus 11 differs from the above-described apparatus 10 in that the base of the apparatus has a single horizontal beam 140, and a single foot ramp 500 is connected to the horizontal beam 140. Also, the exercise apparatus 11 includes a video display monitor 600. The exercise apparatus 11 can be configured such that the user may perform the same squatting exercise as described above. In this regard, the foot ramp 500 provides two foot support surfaces 501A and 501B for the users feet, with each of the foot support surfaces 501A and 501B being configured in the same manner as each foot support surface 402 of the foot ramp 40 described above. Further, the apparatus 11 is configured with particular ranges of distances in the horizontal X direction and vertical Y direction between a center of the pad surface 280 and a center of the foot support surfaces 501A and 501B the foot ramp 500 as in the apparatus 10 described above.

Figure 12A:
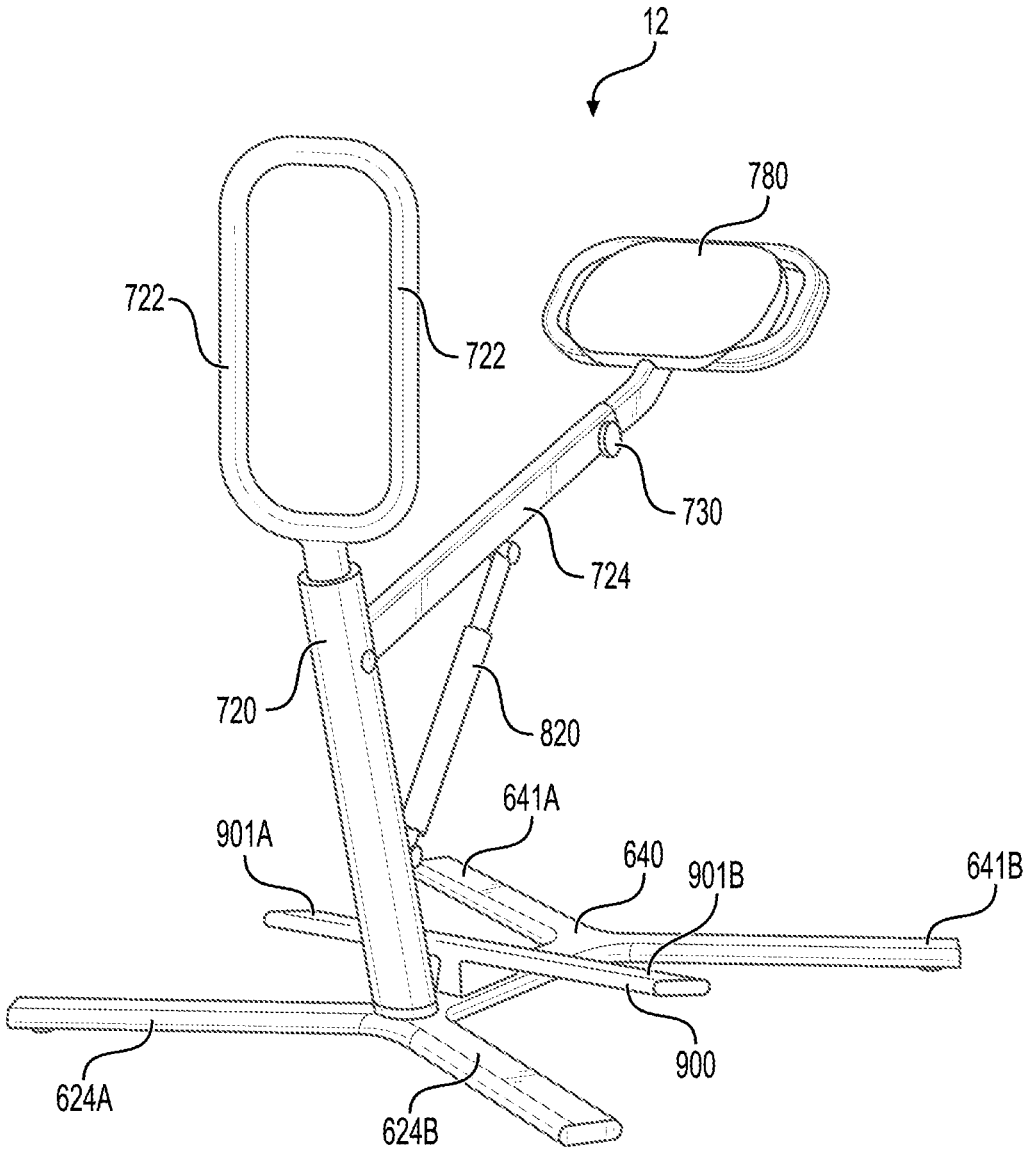
FIG. 12A is a perspective view of an apparatus.
Figure 12B:
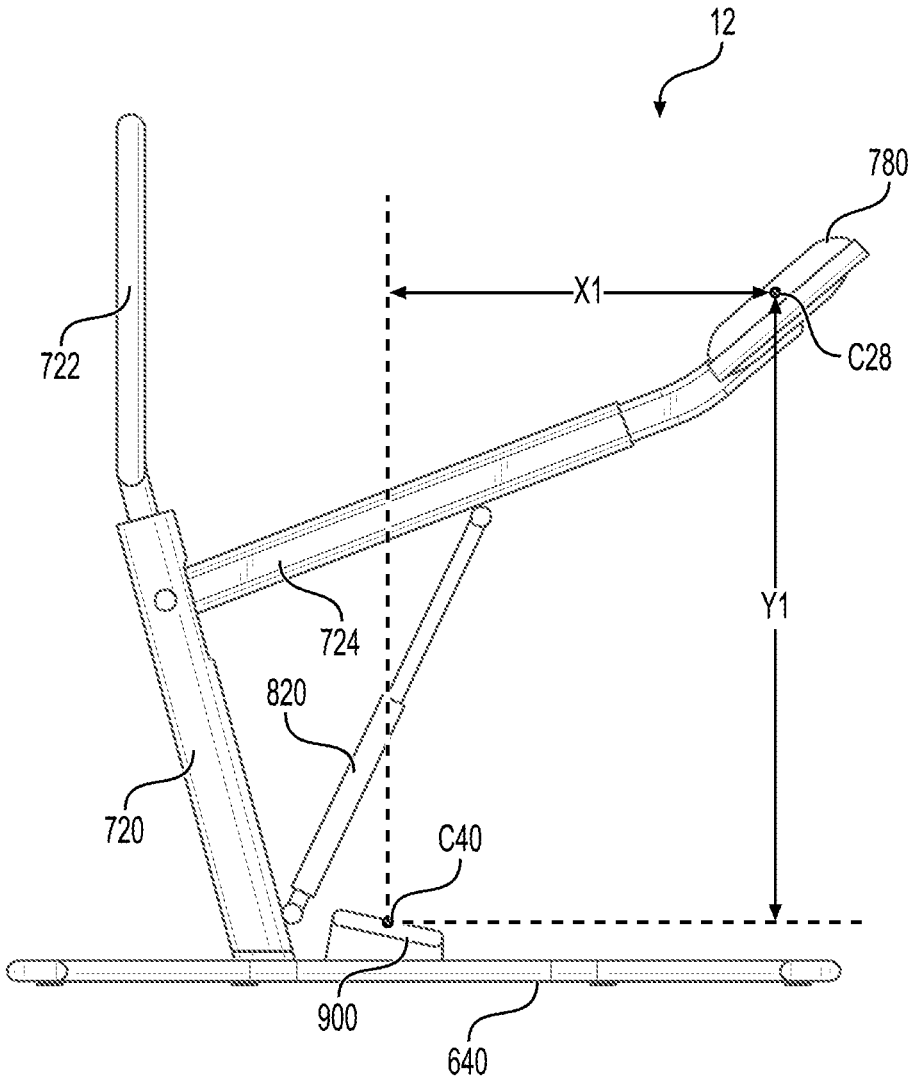
FIG. 12B is a side view of an apparatus.
Figure 12C:
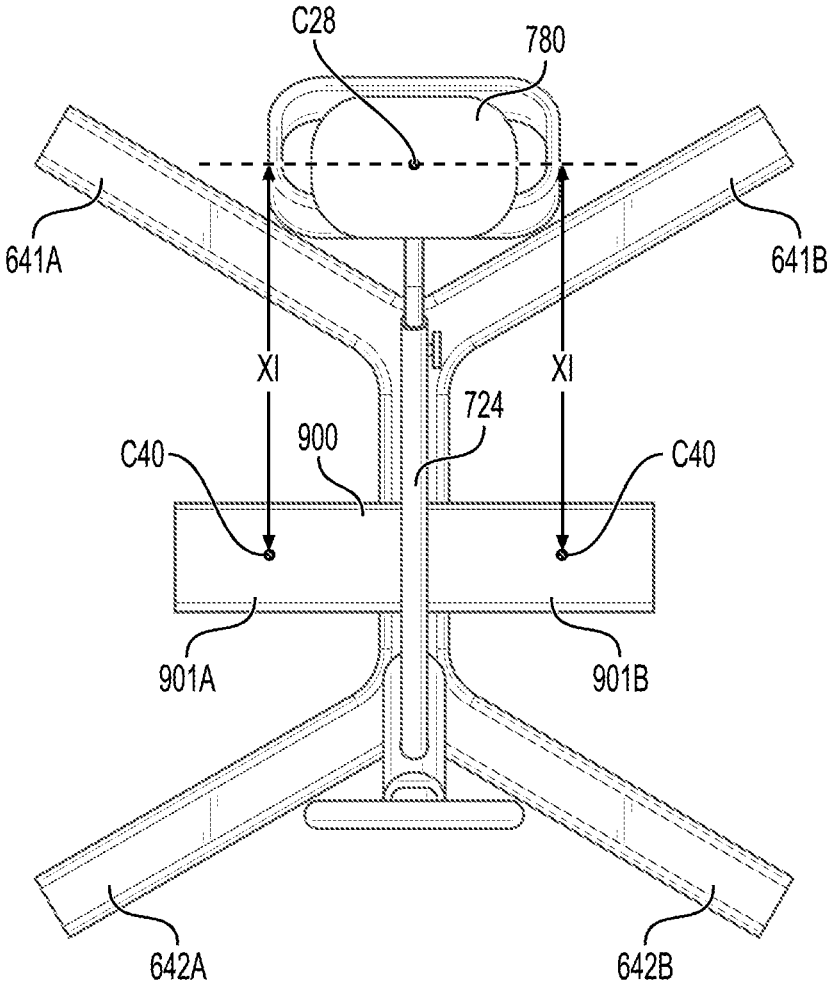
FIG. 12C is a top view of an apparatus, according to an alternative embodiment of the invention.

FIGS. 12A-12C show an exercise apparatus 12 according to an alternative embodiment of the invention. Similar to the above-described exercise apparatuses 10 and 11, in this embodiment the apparatus 12 includes a horizontal beam 640, an upright beam 720, a linking rod 820, two handles 722, a pad support arm 724, and a buttock pad surface 780, with the support arm 720 having telescoping construction such that the overall length of the support arm 720 may be maintained by locking knob assembly 730. The exercise apparatus 12 differs from the above-described apparatuses in that the base of the apparatus has two arms 642A and 642B at the front side of the apparatus and two arms 641A and 641B at the rear side of the apparatus. A single foot ramp 900 is connected to the horizontal beam 640. The exercise apparatus 12 can be configured such that the user may perform the same squatting exercise as described above. In this regard, the foot ramp 900 provides two foot support surfaces 901A and 901B for the users feet, with each of the foot support surfaces 901A and 901B being configured in the same manner as each foot support surface 402 of the foot ramp 40 described above. Further, the apparatus 12 is configured with particular ranges of distances in the horizontal X direction and vertical Y direction between a center of the pad surface 280 and centers of the foot support surfaces 901A and 901B of the foot ramp 900 as in the apparatus 10 described above.

Figure 13:
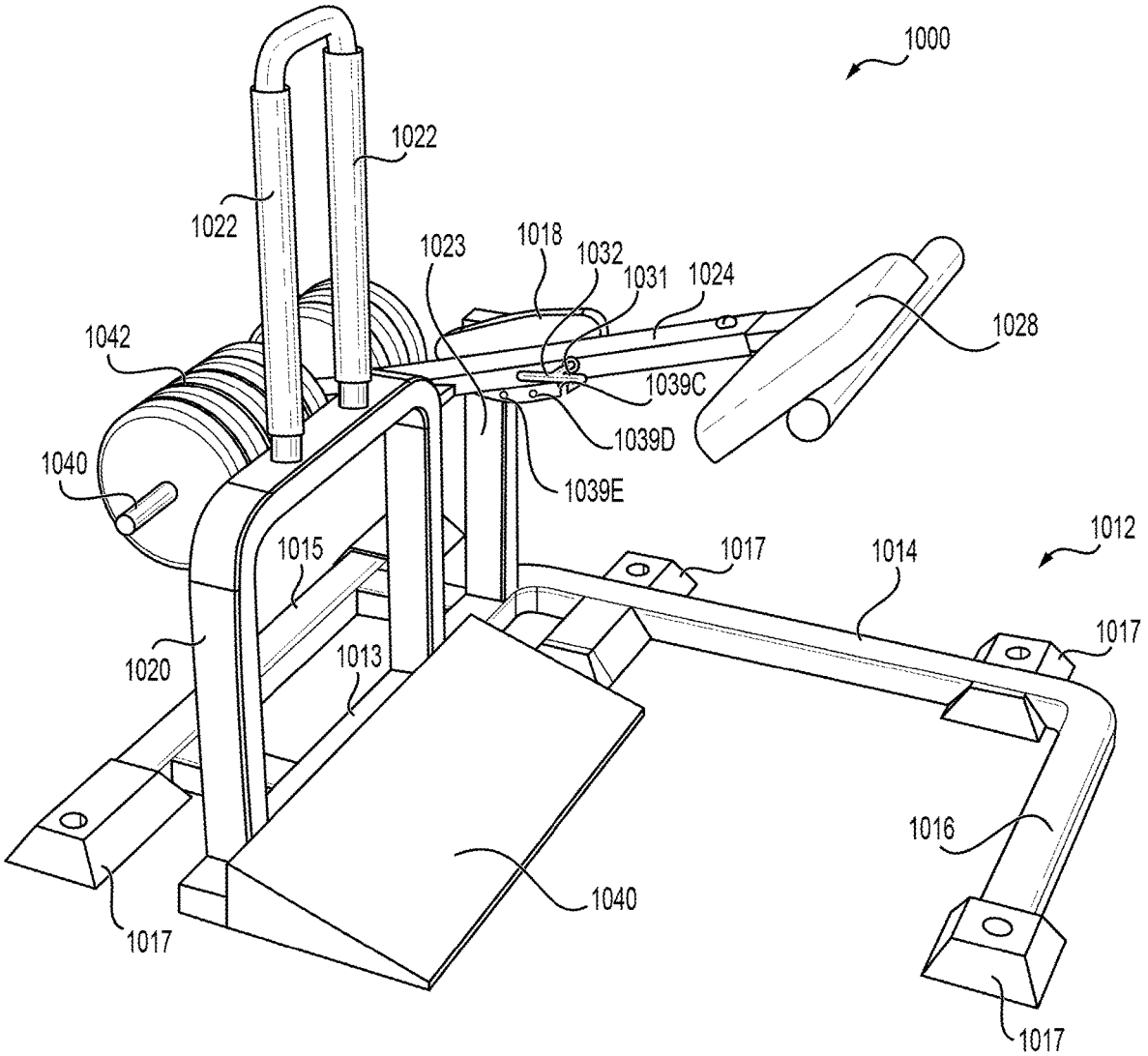
FIG. 13 is a perspective view of an apparatus according to another embodiment of the invention.
Figure 14:
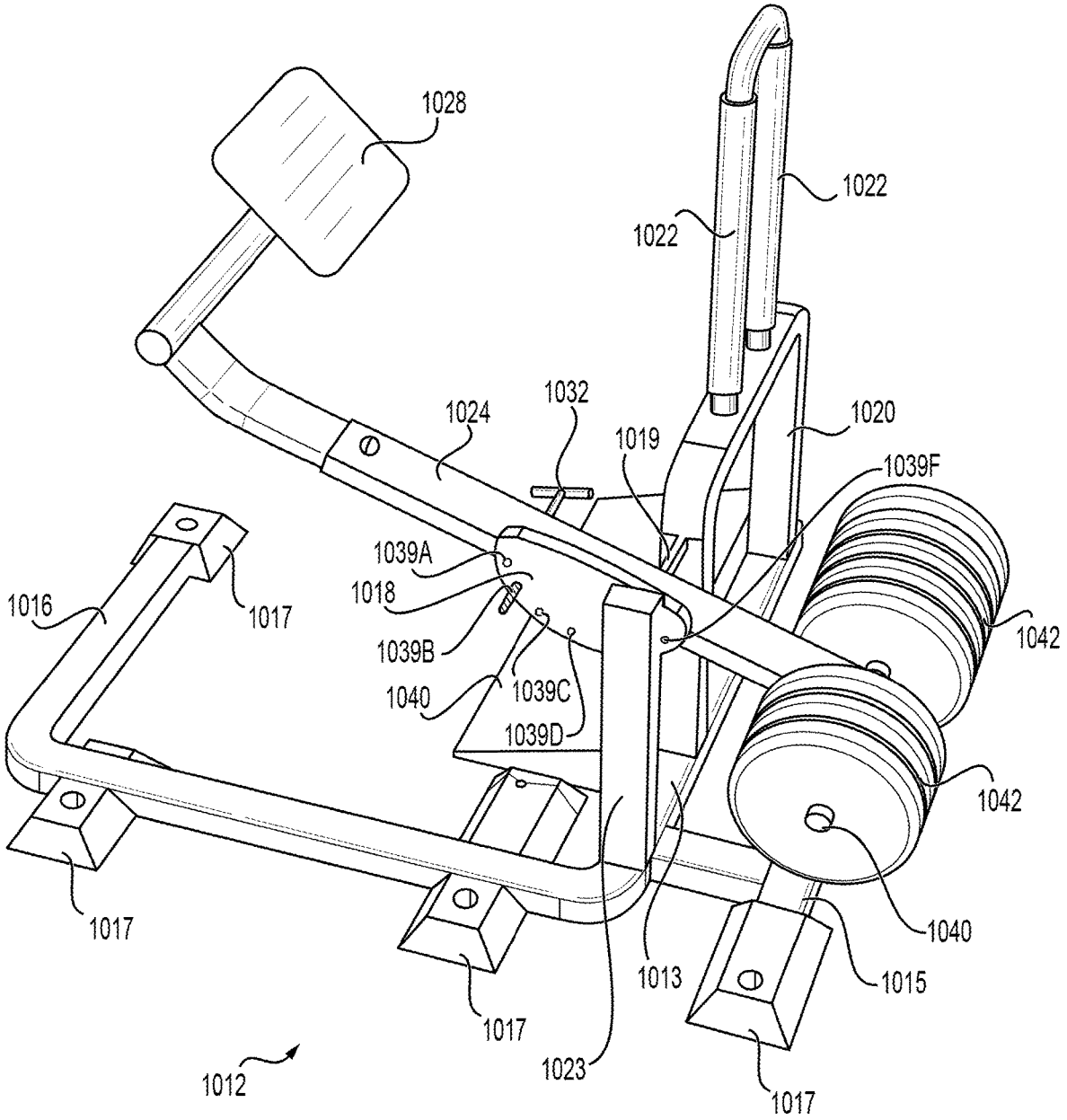
FIG. 14 is another perspective view of the apparatus shown in FIG. 13.

FIGS. 13 and 14 show perspective views of an exercise apparatus 1000 according to another embodiment of the invention. As with the previously described embodiments, the exercise apparatus 1000 may be used to perform a squat exercise. However, as described below, the exercise apparatus 1000 differs from the above-described embodiments in that it is configured to provided weighted resistance in the squat exercise.

The exercise apparatus 1000 includes a base 1012 with four beams 1013, 1014, 1015, and 1016. Slip-resistant floor pads 1017 are positioned on the beams 1013, 1014, 1015, and 1016. A U-shaped upright beam 1020 extends upwardly from the beam 1013, and a pair of handles 1022 extend upwardly from the beam 1020. The handles 1022 may be provided with a cushioned covering to provide a comfortable surface for the user's hands. The handles 1022 may also be adjustable in height to accommodate users of varying heights. As will be appreciated by those skilled in the art, in alternative embodiments the handles may be positioned and configured differently than as shown in the depicted embodiment. For example, in another embodiment, a horizontal handle bar is provided for the user to grip.

Another upright beam 1023 extends upwardly from the beam 1013. The upright beam 1023 supports an axle 1019, and a support arm 1024 is pivotable about the axle 1019. The arm 1024 supports at its distal end the buttock pad surface 1028. The support arm 1024 may be telescoping, and may be maintained, for example, by a locking knob as in the above-described embodiments.

The exercise apparatus 1000 includes a positioning cam 1018 that is connected to the support arm 1024 and the upright beam 1023. A plurality of openings 1039A-1039E are formed through the positioning cam 1018. An opening 1031 in the support arm 1024 may be positioned to align with one of the openings 1039A-1039E, and this alignment may be fixed by using a locking pin 1032 that extends through the opening 1031 and the aligned one of the openings 1039A-1039E. An initial angle of the arm 1024 and the pad 1028 with respect to the horizontal (ground) can be adjusted by selecting the one of the openings 1039A-1039E to align with the opening 1031. Thus, the pad 1028 may be adjusted to accommodate users of different heights and leg/torso proportions.

A weight support bar 1040 extends from a front end of the support arm 1024. The support bar 1040 extends from opposite sides of the support arm 1024 such that the disc weights 1042 may be placed on both sides of the support arm 1024. By providing the weights 1042 on both sides of the support arm 1024, less stress is imparted on bar and less stress is imparted on rotation bearings as compared to a configuration in which the weights are placed on one side of the support arm 1024.

When the support arm 1024 and buttocks support pad 1028 are in a first position shown in FIGS. 13 and 14, the support pad 1028 is positioned above the weights 1042 in the vertical direction. As the user moves downward in a squat motion against the support pad 1028, the weights 1042 are moved upward. Thus, the weights 1042 provide a resistive force to the downward squat motion of the user of the exercise apparatus 1000. The resistive force is directly proportional to the number of weights 1042 supported on the support bar 400, and, thus, the force can be easily adjusted over a wide range with the addition/subtraction of the weights 1042. The weights 1042 also provide an assistive force when the user beings the upward motion from the bottom of the squat. And, while the assistive force from the weights 1042 helps the user to move upward, the user may also gain benefit by resisting against the upward force provided by the weights and the biasing element of the linkage system 1032. That is, if the user moves slowly upward against the assistive force, the squat exercise is further enhanced.

The configuration of the apparatus 1000 allows users to easily enter and initially position themselves in the apparatus. That is, as shown in FIG. 13, users may enter the apparatus from the left side of the apparatus without the need for lifting their legs over a part of the apparatus. The configuration may therefore be beneficial for users that have limited mobility. And the apparatus 1000 can easily be used, for example, as part of a rehabilitation program for an injured person. Those skilled in the art will of course appreciate that while the open side is on the left in the depicted embodiments, the apparatus configuration could be reversed such that apparatus open to the right side as shown in the figures.

The exercise apparatus 1000 also includes a foot ramp structure 1040, which may have the configurations of the foot ramp structures in the above-described embodiments. For example, the foot ramp structure 1040 may be configured to have the same angles relative to the ground, the same foot support surface area, and the same positioning relative to the buttocks support pad 1028 as in the above-described embodiments. As also in the above-described embodiments, the foot ramp structure 1040 is sized and configured such that the entire foot of a user is supported by the structure. While the foot ramp structure 1040 depicted in FIGS. 13 and 14 is provided as singular structure for both feet of a user, in other embodiments, separate foot ramps for the user's feet may be provided on the right and left sides of the apparatus 1000. In still other embodiments, the foot ramp structure 1040 may be made adjustable such that the angle of the foot support surface relative to the ground can be varied.

As compared to the exercise apparatus described in the '017 Patent, the exercise apparatus 1000 is a simpler machine. For example, unlike the exercise apparatus described in the '017 Patent, the exercise apparatus 1000 does not include a pulley system and all movements are achieved with rotation bearings. Also, the weights 1042 used with the exercise apparatus 1000 may be easily modified and/or exchanged, whereas the apparatus described in the '017 Patent may need to be disassembled if it is necessary to exchange the weights used therein. The elevated position of the weights in the embodiments described herein may also be provided for a smoother movement in conjunction with the rotation bearings.

Figure 15:
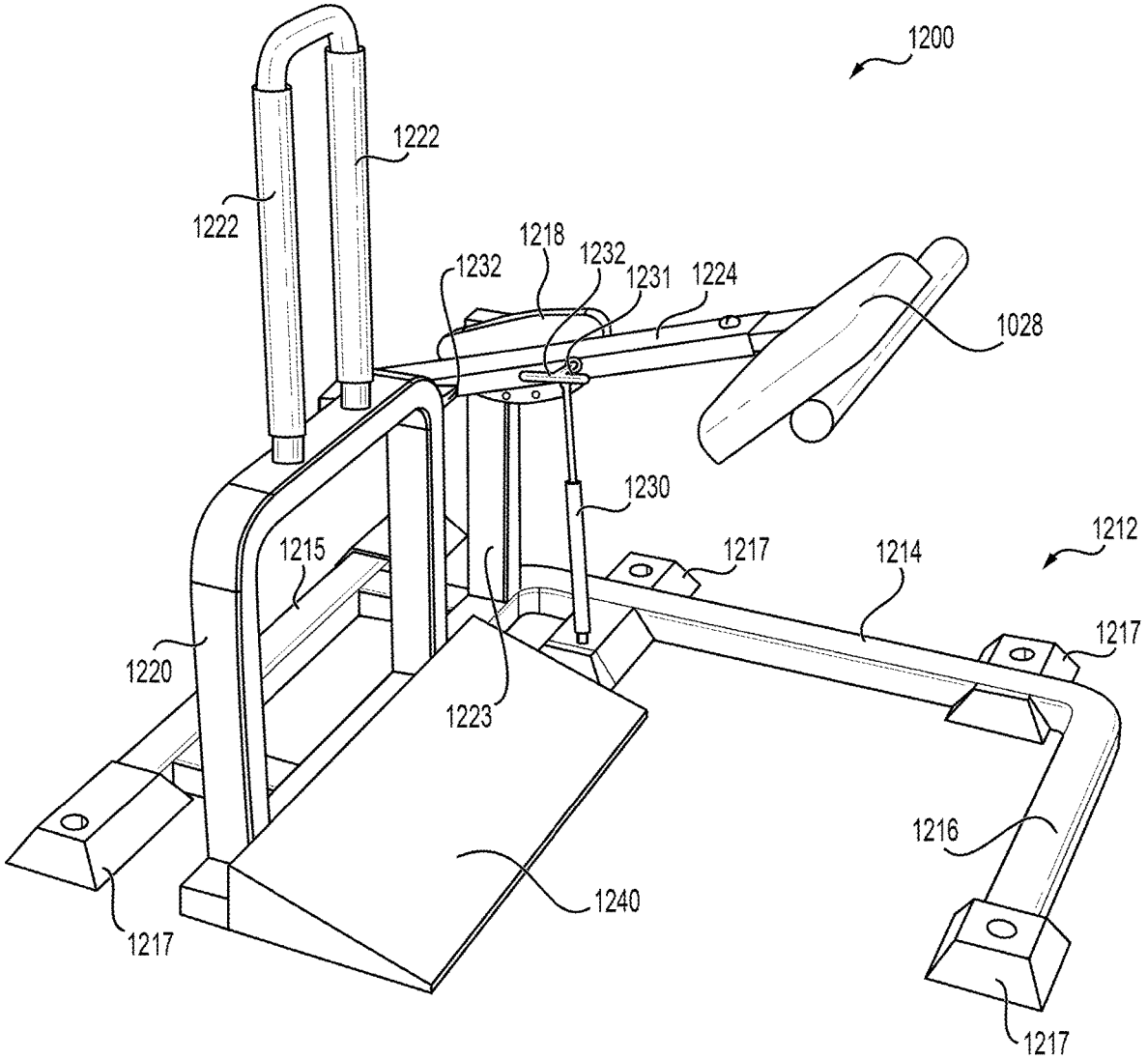
FIG. 15 is a perspective view of an apparatus according to a further embodiment of the invention.
Figure 16:
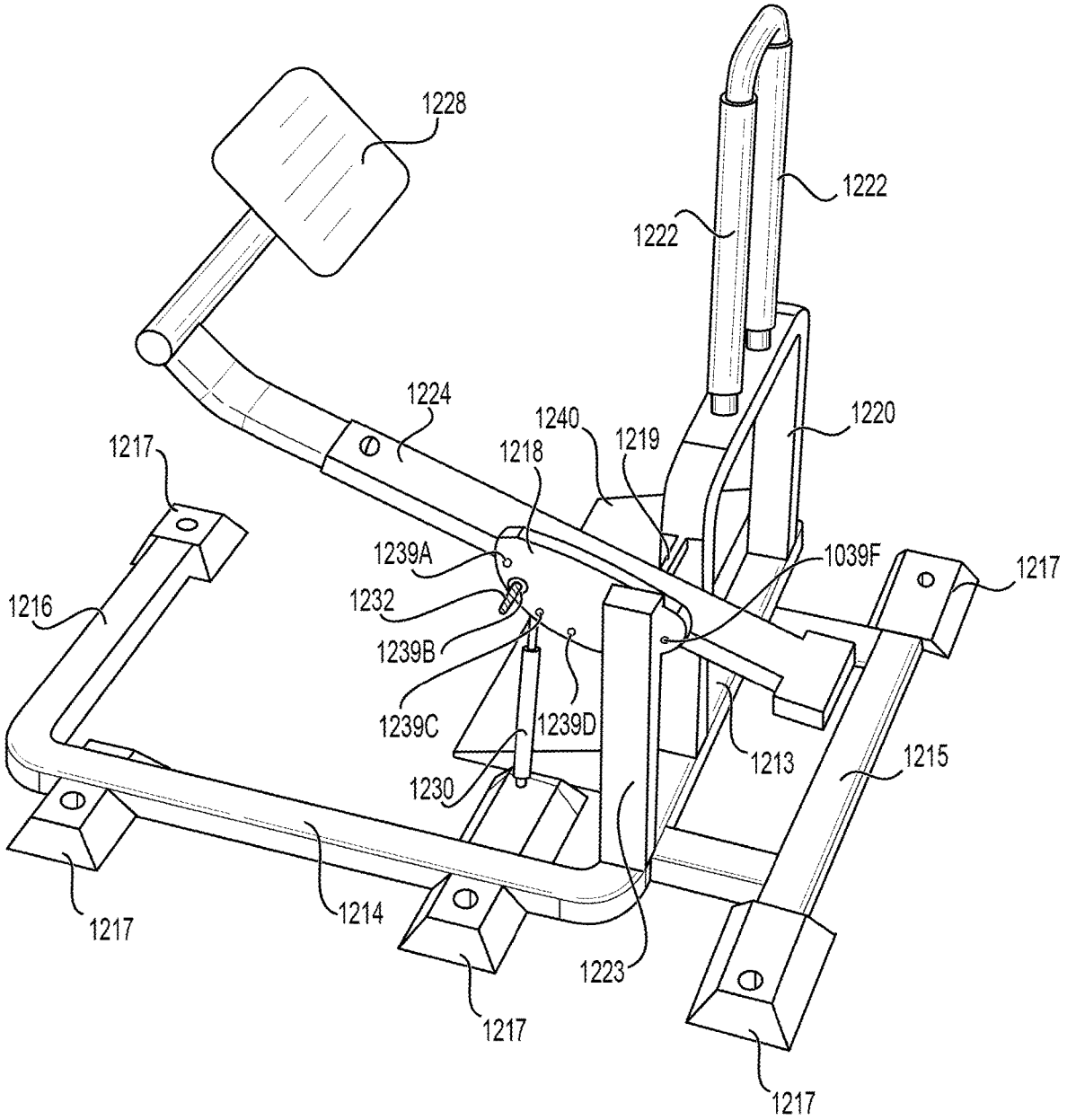
FIG. 16 is another perspective view of the apparatus shown in FIG. 15.

FIGS. 15 and 16 shows another embodiment of the invention. The apparatus 1200 in this embodiment includes many of the same features as the embodiment depicted in FIGS. 14 and 15, including a base 1212 with four beams 1213, 1214, 1215, and 1216, and slip-resistant floor pads 1217 are positioned on the beams 1213, 1214, 1215, and 1216. A U-shaped upright beam 1220 extends upwardly from the beam 1213, and a pair of handles 1022 extend upwardly from the beam 1220. Another upright beam 1223 extends upwardly from the beam 1213. The upright beam 1223 supports an axle 1219, and a support arm 1224 is pivotable about the axle 1219. The arm 1224 supports at its distal end the buttock pad surface 1228. The support arm 1224 may be telescoping, and may be maintained, for example, by a locking knob as in the above-described embodiments. A positioning cam 1218 is connected to the support arm 1224 and the upright beam 1223 and a plurality of openings 1239A-1239E are formed through the positioning cam 1218. An opening 1231 in the support arm 1024 fixed with a locking pin 1232 in alignment with one of the openings 1239A-1239E, as in the above-described apparatus 1000. Like the apparatus 1000, the apparatus 1200 has an open configuration on one side that allows users to easily position themselves on the apparatus.

The exercise apparatus 1200 also includes a foot ramp structure 1240, which may have the configurations of the foot ramp structures in the above-described embodiments. For example, the foot ramp structure 1240 may be configured to have the same angles relative to the ground, the same foot support surface area, and the same positioning relative to the buttocks support pad 1228 as in the above-described embodiments. As also in the above-described embodiments, the foot ramp structure 1240 is sized and configured such that the entire foot of a user is supported by the structure. While the foot ramp structure 1240 depicted in FIGS. 15 and 16 is provided as singular structure for both feet of a user, in other embodiments, separate foot ramps for the user's feet may be provided on the right and left sides of the apparatus 1200. In still other embodiments, the foot ramp structure 1240 may be made adjustable such that the angle of the foot support surface relative to the ground can be varied.

Instead of a weight support bar as in the above-described apparatus 1000, the apparatus 1200 includes a linkage system 1230. As with linkage systems in the above-described embodiments, the linkage system 1032 includes a biasing element, such as damper. The biasing element provides an opposing force against downward motion of the buttocks pad 1028 and support arm 1024, as well as a returning force to drive the pad 1028 and support arm 1024 upward from a lowered position. The damper may be adjustable to control the force level. In some embodiments, a dial structure may be included to allow a user to change the resistance to compression provided by the damper.

As with the configuration of the apparatus 1000, the configuration of the apparatus 1200 allows users to easily enter and initially position themselves in the apparatus. That is, as shown in FIG. 15, users may enter the apparatus from the left side of the apparatus without the need for lifting their legs over a structure, or users could enter the apparatus from a right side in an embodiment reversed from that depicted in FIG. 15.

Yet another embodiment of the invention includes the combination of features of the apparatus 1000 and the apparatus 1200. In this embodiment, the apparatus includes a weight support bar configured to support disc weights, as in the apparatus 1000, and the apparatus includes a linkage system with a biasing element, as in the apparatus 1200. The apparatus in this embodiment also includes the same configuration of a base, upright beams, a support arm, a buttocks support pad, handles, and a foot ramp, as in the apparatuses 1000 and 1200.

While various example embodiments of the invention have been described above, it should be understood that they have been presented by way of example, and not limitation. It is apparent to persons skilled in the relevant art(s) that various changes in form and detail can be made therein. Thus, the invention should not be limited by any of the above-described example embodiments, but should be defined only in accordance with the following claims and their equivalents.

The invention claimed is:

1. An exercise apparatus comprising:

a base comprising at least one horizontal beam;

at least one upright beam configured to be connected to the base and extending upward of the base, the upright beam comprising at least one handle area configured to be held by a user, the upright beam configured to be positioned at a front side of the apparatus;

a buttocks support assembly comprising a buttocks support configured to be positioned rearward of the upright beam, the buttocks support assembly being pivotal with respect to the at least one upright handle between a first position and a second position, with the first position being farther from the base than the second position is from the base; and a foot ramp structure comprising a pair of foot ramps and configured to be positioned rearward of the upright beam, the foot ramp structure comprising at least one foot support surface having a surface area sufficient to support substantially all of the user's feet in a position that is elevated off a ground, wherein each foot ramp comprises a clip comprising a channel, each of the clips being configured to:

couple to the base for positioning on the base; and couple to a respective foot ramp for affixing the clip adjacent to a side of the respective foot ramp.

2. The exercise apparatus according to claim 1, wherein the at least one foot support surface is configured such that the at least one foot support surface has an area of at least about 300 $cm^2$ on one side of the exercise apparatus and an area of at least about 300 $cm^2$ on a second side of the exercise apparatus.

3. The exercise apparatus according to claim 1, wherein the pair of foot ramps includes a left-side foot ramp structure and a right-side foot ramp structure, wherein, as viewed towards the front side of the apparatus, the left-side foot ramp structure is configured to be positioned to a left of at least a part of the base and the right-side foot ramp structure is configured to be positioned to a right of at least a part of the base.

4. The exercise apparatus according to claim 3, wherein each of the left-side foot ramp and the right-side foot ramp has a foot support surface with an area of at least about 300 $cm^2$.

5. The exercise apparatus according to claim 1, further comprising a base assembly comprising the base and the at least one upright beam and a linking rod configured to be connected to the base assembly and to the buttocks support assembly.

6. The exercise apparatus according to claim 1, wherein each foot ramp is configured to be coupled to the base by inserting the at least one horizontal beam into an opening of the channel.

7. The exercise apparatus according to claim 1, wherein each foot ramp has the shape of a trapezoidal prism with an obtuse angle y being formed between the foot support surface and an adjacent front surface of each foot ramp.

8. An exercise apparatus comprising:

a base comprising at least one horizontal beam;

at least one upright beam configured to be connected to the base and extending upward of the base, the upright beam comprising at least one handle area configured to be held by a user, the upright beam configured to be positioned at a front side of the apparatus;

a buttocks support assembly comprising a buttocks support configured to be positioned rearward of the upright beam, the buttocks support assembly being pivotal with respect to the at least one upright handle between a first position and a second position, with the first position being farther from the base than the second position is from the base, the buttocks support assembly comprising a surface configured to support the buttocks of the user; and a foot ramp structure comprising a pair of foot ramps and configured to be positioned rearward of the upright beam, the foot ramp structure comprising at least one foot support surface configured to support the user's feet, wherein each foot ramp comprises a clip comprising a channel, each of the clips being configured to:

couple to the base for positioning on the base; and couple to a respective foot ramp for affixing the clip adjacent to a side of the respective foot ramp;

wherein the apparatus is configured such that when the buttocks support assembly is in the first position, a distance in a horizontal direction from a center of the surface of the buttocks support surface to a center of the foot support surface is about 30 cm to about 60 cm, and a distance in a vertical direction from the center of the surface of the buttocks support surface to a center of the at least one foot support surface is about 80 cm to about 90 cm.

9. The exercise apparatus according to claim 8, wherein the at least one foot support surface is configured such that the at least one foot support surface has an area of at least about 300 $cm^2$ on one side of the exercise apparatus, and an area of at least about 300 $cm^2$ on a second side of the exercise apparatus.

10. The exercise apparatus according to claim 8, wherein the pair of foot ramps includes a left-side foot ramp structure and a right-side foot ramp structure, wherein, as viewed towards the front side of the apparatus, the left-side foot ramp structure is configured to be positioned to a left of at least a part of the base and the right-side foot ramp structure is configured to be positioned to a right of at least a part of the base.

11. The exercise apparatus according to claim 8, further comprising a base assembly comprising the base and the at least one upright beam and a linking rod configured to be connected to the base assembly and to the buttocks support assembly.

12. The exercise apparatus according to claim 11, wherein each of the foot support surfaces have an area of at least about 300 $cm^2$.

13. The exercise apparatus according to claim 8, wherein each foot ramp is configured to be coupled to the base by inserting the at least one horizontal beam into an opening of the channel.

14. The exercise apparatus according to claim 8, wherein each foot ramp has the shape of a trapezoidal prism with an obtuse angle y being formed between the foot support surface and an adjacent front surface of each foot ramp.

15. An exercise apparatus comprising:

a base comprising at least one horizontal beam;

at least one upright beam configured to be connected to the base and extending upward of the base the upright beam comprising at least one handle area configured to be held by a user, the upright beam configured to be positioned at a front side of the apparatus, wherein a base assembly comprises the base and the at least one upright beam;

a buttocks support assembly comprising a buttocks support configured to be positioned rearward of the upright beam, the buttocks support assembly being pivotal with respect to the at least one upright handle between a first position and a second position, with the first position being higher relative to the second position;

a linking rod configured to be connected to the base assembly and the buttocks support assembly; and a foot ramp structure comprising a pair of foot ramps and configured to be positioned rearward of the upright beam, the foot ramp structure comprising at least one foot support surface having a surface area of at least about 500 $cm^2$ to support the user's feet in a position that is elevated off a ground, wherein each foot ramp comprises a clip comprising a channel, each of the clips being configured to:

couple to the base for positioning on the base; and couple to a respective foot ramp for affixing the clip adjacent to a side of the respective foot ramp, wherein the at least one foot support surface is formed at an angle between about 10° to about 35° relative to the ground.

16. The exercise apparatus according to claim 15, wherein the pair of foot ramps includes a left-side foot ramp structure and a right-side foot ramp structure, wherein, as viewed towards the front side of the apparatus, the left-side foot ramp structure is configured to be positioned to a left of at least a part of the base and the right-side foot ramp structure is configured to be positioned to a right of at least a part of the base.

17. The exercise apparatus according to claim 15, wherein each foot ramp is configured to be coupled to the base by inserting the at least one horizontal beam into an opening of the channel.

18. The exercise apparatus according to claim 15, wherein the each foot ramp has the shape of a trapezoidal prism with an obtuse angle y being formed between the foot support surface and an adjacent front surface of each foot ramp.

19. The exercise apparatus according to claim 15, wherein the at least one foot support surface is formed at an angle between about 15° to about 20° relative to the ground.

20. An exercise apparatus for a squat exercise, the apparatus comprising:

a base comprising at least one horizontal beam;

at least one upright beam configured to be connected to the base and extending upward of the base, the upright beam comprising at least one handle area configured to be held by a user, and the upright beam configured to be positioned at a front side of the apparatus;

a buttocks support assembly comprising a buttocks support configured to be positioned rearward of the upright beam, the buttocks support assembly being pivotal with respect to the at least one upright handle between a first position and a second position, with the first position being farther from the base than the second position is from the base;

a weight support beam operatively connected to the buttocks support assembly, the weight support beam being configured to support one or more weights; and a foot ramp structure comprising a pair of foot ramps and configured to be positioned rearward of the upright beam, the foot ramp structure comprising at least one foot support surface having a surface area sufficient to support substantially all of the user's feet in a position that is elevated off a ground, wherein each foot ramp comprises a clip comprising a channel, each of the chips being configured to:

couple to the base for positioning on the base; and couple to a respective foot ramp for affixing the clip adjacent to a side of the respective foot ramp.

21. The exercise apparatus according to claim 20, wherein, when the buttocks support assembly is in the first position, the weight support beam is configured to be positioned to support the one or more weights in an elevated position above the ground supporting the exercise apparatus.

22. The exercise apparatus according to claim 20, wherein the buttocks support assembly includes a support pad at a first end and the weight support beam is configured to be positioned adjacent to a second end of the buttock support assembly.

* * * * *